United States Patent [19]

Inoue et al.

[11] Patent Number: 4,994,364

[45] Date of Patent: Feb. 19, 1991

[54] DIRECT POSITIVE IMAGE FORMING METHOD

[75] Inventors: Noriyuki Inoue; Morio Yagihara, both of Kanagawa, Japan

[73] Assignee: Fuji Photo Film Co., Ltd., Kanagawa, Japan

[21] Appl. No.: 394,386

[22] Filed: Aug. 15, 1989

[30] Foreign Application Priority Data

Aug. 16, 1988 [JP] Japan ..... 63-202746

[51] Int. Cl.[5] ..... G03C 5/50

[52] U.S. Cl. ..... 430/598; 430/264; 430/379; 430/409; 430/410; 430/411; 430/596; 430/611; 430/613; 430/940

[58] Field of Search ..... 430/264, 378, 410, 409, 430/940, 411, 596, 598, 611, 613

[56] References Cited

U.S. PATENT DOCUMENTS 4,835,091 5/1989 Inoue et al. ..... 430/378

*Primary Examiner*—Paul R. Michl
*Assistant Examiner*—Thorl Chea
*Attorney, Agent, or Firm*—Sughrue, Mion, Zinn, Macpeak & Seas

[57] ABSTRACT

A direct positive image forming method comprising development processing an imagewise exposed direct positive photographic light-sensitive material which comprises a support having thereon at least one layer containing internal latent image type silver halide grains not having been previously fogged after fogging treatment or while fogging treatment, wherein the fogging treatment is conducted in the presence of a compound represented by the following general formula (I):

(I)

wherein $A_1$ and $A_2$ both represent a hydrogen atom or one of $A_1$ and $A_2$ represents a hydrogen atom and the other represents a sulfonyl group or an acyl group; $G_1$ represents a carbonyl group, a sulfonyl group, a sulfoxy group, or an iminomethylene group; $L_1$ represents a divalent linkage group; $X_1$ represents —O— or wherein $R_4$ represents a hydrogen atom, an alkyl group or an aryl group); $Y_1$ represents $R_1$ and $R_2$ each represents an aliphatic group, an aromatic group, a heterocyclic group, $—OR_5$ or $—NR_5R_6$ (wherein $R_5$ represents an aliphatic group, an aromatic group or a heterocyclic group; and $R_6$ represents a hydrogen atom, an aliphatic group, an aromatic group or a heterocyclic group); and $R_3$ represents a hydrogen atom, an alkyl group, an aryl group, an alkoxy group, an aralkyl group, an aryloxy group or an amino group.

In accordance with the method of the present invention direct positive images having a high maximum image density and a low minimum image density and being stable even when preserved under high temperature and high humidity conditions.

53 Claims, No Drawings

DIRECT POSITIVE IMAGE FORMING METHOD

FIELD OF THE INVENTION

The present invention relates to a direct positive image forming method comprising develop processing a direct positive photographic light-sensitive material which comprises a support having thereon at least one layer containing internal latent image type silver halide grains not have been previously fogged after fogging treatment or while fogging treatment, and more particularly to a direct positive image forming method which can provide a sufficiently high $D_{max}$ even upon development processing at a low pH.

BACKGROUND OF THE INVENTION

It is well known that an internal latent image type silver halide emulsion not having been previously fogged is imagewise exposed to light and then subjected to surface development either after fogging treatment or while fogging treatment to obtain a direct positive image.

The term "internal latent image type silver halide photographic emulsion" uses herein means a silver halide photographic emulsion of the type in which sensitivity specks are predominantly present in the interior of silver halide grains and a latent image is predominantly formed in the interior of the grains by exposure to light.

Various techniques in this field of technology, such as those described, for example, in U.S. Pat. Nos. 2,592,250, 2,466,957, 2,497,875, 2,588,982, 3,317,322, 3,761,266, 3,761,276, and 3,796,577, British Pat. Nos. 1,151,363, 1,150,553, and 1,011,062. According to these conventional techniques, photographic light-sensitive materials providing a direct positive image with relatively high sensitivity can be produced.

For the details of the direct positive image formation mechanism, reference can be made to it, for example, in T.H. James, *The Theory of the Photographic Process*, 4th. Ed., Ch. 7, pp. 182 to 193 and U.S. Pat. No. 3,761,276.

It is believed that a direct positive image is formed through the following mechanism: First, imagewise exposure results in the formation of an internal latent image in the interior of silver halide grains, which leads to the formation of fog centers selectively on the surface of the unexposed silver halide grains by surface desensitization based on the internal latent image, and subsequent conventional surface development processing results in formation of a photographic image (a direct positive image) on the unexposed area.

Selective formation of fog centers described above can be generally effected by a "light fogging method" in which the entire surface of a light-sensitive layer is secondarily exposed to light as described, for example, in British Pat. No. 1,151,363 or a "chemical fogging method" using a nucleating agent as described, for example, in *Research Disclosure*, Vol. 151, No. 15162 (Nov., 1976), pp. 76 to 78.

Hydrazine compounds are well known as nucleating agents which are employed in the above-described "chemical fogging method".

As another type of nucleating agents, heterocyclic quaternary ammonium salts are known and described, for example, in U.S. Pat. Nos. 3,615,615, 3,719,494, 3,734,738, 3,759,901, 3,854,956, 4,094,683 and 4,306,016, British Pat. Nos. 1,283,835, JP-A-52-3426, and JP-A-52-69613 (the term "JP-A" as used herein means an "unexamined published Japanese patent application").

In general, the above described hydrazine type nucleating agents are most excellent in view of discrimination since they provide a large difference between maximum density ($D_{max}$) and minimum density ($D_{min}$). However, they are disadvantageous because they require processing at a high pH (pH>12).

As nucleating agents which function in processing at a low pH (pH≦12), heterocyclic quaternary ammonium salts as described above are known. Particularly, propargyl- or butynyl-substituted heterocyclic quaternary ammonium salt compounds as described in U.S. Pat. No. 4,115,122 are excellent nucleating agents in view of discrimination when used in direct positive silver halide emulsions.

However, in silver halide emulsions, sensitizing dyes are employed for the purpose of spectral sensitization. In such cases, competitive adsorption of the sensitizing dyes and the heterocyclic quaternary ammonium type nucleating agents onto silver halide grains takes place, and thus, it is necessary to add a large amount of the quaternary ammonium salt type nucleating agents which are of low adsorptivity. In particular, in the case of multilayer color photographic light-sensitive materials, unevenness of density and destroy of color balance may undesirably occur. Therefore, these compounds are still insufficient. Further, these tendencies become more remarkable upon preservation of the photographic material under high temperature and high humidity conditions.

In order to solve the above described problems, quaternary salt type nucleating agents having an AgX adsorption accelerating thioamido group are disclosed in U.S. Pat. No. 4,471,044. Although the amount to be added necessary to obtain a sufficiently high $D_{max}$ is reduced and the decrease in $D_{max}$ during preservation at high temperature is controlled by introduction of the adsorptive group, these effects do not still achieve to a fully satisfactory level.

SUMMARY OF THE INVENTION

It is, therefore, an object of the present invention to provide a direct positive image forming method which provides a high maximum image density and a low minimum image density.

Another object of the present invention is to provide a direct positive image forming method which forms stable direct positive images even when they are preserved under high temperature and/or high humidity conditions.

Other objects of the present invention will become apparent from the following description and examples.

These objects of the present invention are accomplished with a direct positive image forming method comprising development processing an imagewise exposed direct positive photographic light-sensitive material which comprises a support having thereon at least one layer containing internal latent image type silver halide grains not having been previously fogged after fogging treatment or while fogging treatment, wherein the fogging treatment is conducted in the presence of a compound represented by the following general formula (I):

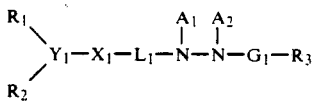

(I)

wherein $A_1$ and $A_2$ both represent a hydrogen atom or one of $A_1$ and $A_2$ represents a hydrogen atom and the other represents a sulfonyl group or an acyl group; $G_1$ represents a carbonyl group, a sulfonyl group, a sulfoxy group,

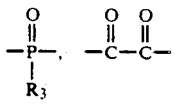

or an iminomethylene group; $L_1$ represents a divalent linkage group; $X_1$ represents —O— or

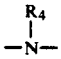

(wherein $R_4$ represents a hydrogen atom, an alkyl group or an aryl group); $Y_1$ represents

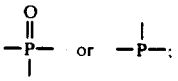

$R_1$ and $R_2$ each represents an aliphatic group, an aromatic group, a heterocyclic group, $—OR_5$ or $—NR_5R_6$ (wherein $R_5$ represents an aliphatic group, an aromatic group or a heterocyclic group; and $R_6$ represents a hydrogen atom, an aliphatic group, an aromatic group or a heterocyclic group); and $R_3$ represents a hydrogen atom, an alkyl group, an aryl group, an alkoxy group, an aralkyl group, an aryloxy group or an amino group.

DETAILED DESCRIPTION OF THE INVENTION

The present invention is based on the fact that highly active hydrazines which can not be expected from the information hitherto known are obtained by introducing the $—Y_1—X_1—$ group into their molecules as described in the general formula (I).

Now, the compound represented by the general formula (I) is described in detail below.

In the general formula (I), $A_1$ and $A_2$ both represent a hydrogen atom or one of them represents a hydrogen atom and the other represents an alkylsulfonyl group having not more than 20 carbon atoms, an arylsulfonyl group having not more than 20 carbon atoms (preferably a phenylsulfonyl group or a phenylsulfonyl group substituted so that the sum of the Hammett's substituent constants becomes at least −0.5), or an acyl group having not more than 20 carbon atoms (preferably a benzoyl group, a substituted benzoyl group so that the sum of the Hammett's substituent constants becomes at least −0.5), or a straight chain, branched chain or cyclic, unsubstituted or substituted aliphatic acyl group (wherein the substituent can be selected from, for example, a halogen atom, an ether group, a sulfonamido group, a carbonamido group, a hydroxyl group, a carboxyl group, and a sulfonic acid group). The most preferably, bath $A_1$ and $A_2$ represents simultaneously hydrogen atoms.

The aliphatic group represented by $R_1$ or $R_2$ includes a straight chain, branched chain or cyclic alkyl group, alkenyl group or alkynyl group and each containing preferably from 1 to 30 carbon atoms, particularly from 1 to 20 carbon atoms. The branched chain alkyl group may contain one or more hetero atoms therein to form a saturated hetero ring.

Specific examples of the aliphatic group include a methyl group, a tert-butyl group, an n-octyl group, a tert-octyl group, a cyclohexyl group, a hexenyl group, a pyrrolidyl group, a tetrahydrofuryl group and an n-dodecyl group.

The aromatic group represented by $R_1$ or $R_2$ includes a monocyclic or dicyclic aryl group, for example, a phenyl group or a naphthyl group.

The heterocyclic group represented by $R_1$ or $R_2$ includes a 3-membered to 10-membered saturated or unsaturated heterocyclic group containing at least one of a nitrogen atom, an oxygen atom or a sulfur atom which may be a monocyclic ring or form a condensed ring together with an aromatic ring or a heterocyclic ring. A 5-membered or 6-membered aromatic heterocyclic group is preferred. Specific examples of the heterocyclic group include a pyridyl group, an imidazolyl group, a quinolinyl group, a benzimidazolyl group, a pyrimidyl group, a pyrazolyl group, an isoquinolinyl group, a benzothiazolyl group and a thiazolyl group.

The aliphatic group, aromatic group and heterocyclic group represented by $R_5$ or $R_6$ in $OR_5$ or $NR_5R_6$ are the same as those described for $R_1$ or $R_2$ respectively.

The group represented by $R_1$, $R_2$, $R_5$ and $R_6$ may be substituted with one or more substituents. Suitable examples of the substituent include an alkyl group, an aralkyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group and a carboxy group. These groups may be further substituted. Also, these groups may combine with each other to form a ring.

$R_1$ or $R_2$ may combine with $L_1$ to form a ring. Further, $R_1$ and $R_2$ may combine with each other to form a ring including a hetero ring which contains one or more hetero atoms (for example, an oxygen atom, a sulfur atom or a nitrogen atom).

The divalent linkage group represented by $L_1$ is an atom or an atomic group including at least one of a carbon atom, a nitrogen atom, a sulfur atom and an oxygen atom. More specifically, it includes an alkylene group, an alkenylene group, an alkynylene group, an arylene group, a heteroarylene group (these groups may be substituted), singly or as a combination thereof. Among them, an arylene group is preferred. The arylene group includes a phenylene group and a naphthylene group and these groups may be substituted. Suitable examples of the substituent include an alkyl group, an aralkyl group, an alkoxy group, an aryl group, an aryloxy group, an alkenyl group, an alkylthio group, an arylthio group, a sulfonyl group, a sulfinyl group, a halogen atom, a cyano group, an acyl group, a nitro group and

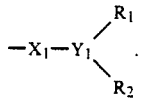

When $G_1$ is a carbonyl group, $R_3$ is preferably a hydrogen atom, an alkyl group (for example, methyl, trifluoromethyl, 3-hydroxypropyl or 3-methanesulfonamidopropyl), an aralkyl group (for example, o-hydroxybenzyl), or an aryl group (for example, phenyl, 3,5-dichlorophenyl, o-methanesulfonamidophenyl or 4-methanesulfonylphenyl).

When $G_1$ is a sulfonyl group, $R_3$ is preferably an alkyl group (for.example, methyl), an aralkyl group (for example, o-hydroxyphenylmethyl), an aryl group (for example, phenyl), or a substituted amino group (for example, dimethylamino).

When $G_1$ is a sulfoxy group, $R_3$ is preferably a cyanobenzyl group or a methylthiobenzyl group.

When G is

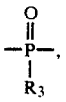

$R_3$ is preferably a methoxy group, an ethoxy group, a bueoxy group, a phenoxy group or a phenyl group.

When $G_1$ is an N-substituted or unsubstituted iminomethylene group, $R_3$ is preferably a methyl group, an ethyl group or a substituted or unsubstituted phenyl group.

Suitable examples of the substituent for $R_3$ include an alkyl group, an aralkyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxy group, an acyloxy group, an acyl group, an alkyloxycarbonyl group, an aryloxycarbonyl group, an alkenyl group, an alkynyl group and a nitro group. These groups may be further substituted. Also, these groups may combine with each other to form a ring.

$G_1$ is most preferably a carbonyl group, and $R_3$ is preferably a hydrogen atom or a group represented by the following general formula (a):

$$-L_2-Z_1 \qquad \text{(a)}$$

wherein $Z_1$ represents a group capable of cleaving the $G_1-L_2-Z_1$ moiety from the remainder molecule upon a nucleophilic attach on $G_1$; and $L_2$ is a divalent organic group capable of forming a $G_1$, $L_2$ and $Z_1$ cyclic structure upon the nucleophilic attack of $Z_1$ on $G_1$.

In more detail, $Z_1$ is a group capable of easily making a nucleophilic attach on $G_1$ to cleave a

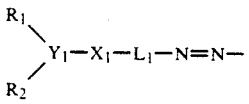

group from $G_1$, when the hydrazine compound represented by the general formula (I) is changed to form

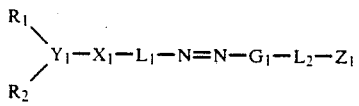

upon oxidation.

Specifically, $Z_1$ may be a functional group which directly reacts with $G_1$, for example, —OH, —SH, —$NHR_7$ (wherein $R_7$ represents a hydrogen atom, an alkyl group, an aryl group, a heterocyclic group, —$COR_8$ or —$SO_2R_8$; and $R_8$ represents a hydrogen atom, an alkyl group, an aryl group or a heterocyclic group) or —COOH (these groups may be temporarily protected so as to form these groups upon hydrolysis by an alkali), or a functional group which becomes possible to react with $G_1$ upon a reaction with a nucleophilic agent such as a hydroxy ion or a sulfite ion, for example,

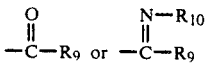

(wherein $R_9$ and $R_{10}$ each represents a hydrogen atom, an alkyl group, an alkenyl group, an aryl group or a heterocyclic group).

The divalent organic group represented by $L_2$ is an atom or an atomic group including at least one of a carbon atom, a nitrogen atom, a sulfur atom and an oxygen atom. More specifically, it includes an alkylene group, an alkenylene group, an alkynylene group, an arylene group, a heteroarylene group (these groups may be substituted), —O—, —S—,

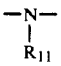

(wherein $R_{11}$ represents a hydrogen atom, an alkyl group or an aryl group), —N=, —CO—, —$SO_2$—, singly or as a combination thereof. Preferably, the ring formed with $G_1$, $Z_1$ and $L_2$ is a 5-membered or 6-membered ring Of the groups represented by the general formula (a), those represented by the general formula (b) or (c) described below are preferred.

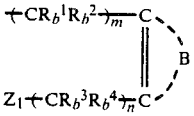

(b)

wherein $R_b^1$, $R_b^2$, $R_b^3$ and $R_b^4$, which may be the same or different, each represents a hydrogen atom, an alkyl group (preferably having from 1 to 12 carbon atoms), an alkenyl group (preferably having from 2 to 12 carbon atoms) or an aryl group (preferably having from 6 to 12 carbon atoms); B represents an atomic group necessary to form a 5-membered or 6-membered ring which may be substituted; m and n each represents 0 or 1, when $Z_1$ is —COOH, n+m is 0 or 1, and when $Z_1$ is —OH, —SH or —$NHR_4$, n+m is 1 or 2; and $Z_1$ has the same meaning as defined in the general formula (a). Specific examples of the 5-membered or 6-membered ring formed with B include a cyclohexene ring, a benzene ring, a naphthalene ring, a pyridine ring, and a quinoline ring.

In the general formula (b), it is preferred that m is 0 and n is 1 and it is particularly preferred that the ring formed with B is a benzene ring.

$$\overset{Rc^3}{\overset{|}{\leftarrow N \rightarrow_p}} \leftarrow CRc^1Rc^2 \rightarrow_q Z_1 \qquad (c)$$

wherein $Rc_1$ and $Rc_2$, which may be the same or different, each represents a hydrogen atom, an alkyl group, an alkenyl group, an aryl group or a halogen atom; $Rc_3$ represents a hydrogen atom, an alkyl group, an alkenyl group or an aryl group; p represents 0 or 1; q represents 1, 2, 3 or 4; and $Z_1$ has the same meaning as defined in the general formula (a), or $Rc^1$, $Rc^2$ and $Rc^3$ may combine with each other to form a ring as far as the resulting structure makes possible an intramolecular nucleophilic attack of $Z_1$ on $G_1$; and when q represents 2 or 3, two or three $CRc^1Rc^2$'s may be the same or different.

In the general formula (c), $Rc^1$ and $Rc^2$ each preferably represents a hydrogen atom, a halogen atom or an alkyl group, $Rc^3$ preferably represents an alkyl group or an aryl group, and q preferably represents 1, 2 or 3, and when q is 1, p is 0 or 1, when q is 2, p is 0 or 1, and when q is 3, p is 0 or 1.

$X_1$ in the general formula (I) represents —O— or —$NR_4$— (wherein $R_4$ represents a hydrogen atom, an alkyl group (for example, methyl, ethyl, or methoxyethyl), or an aryl group (for example, phenyl). $X_1$ is preferably —$NR_4$—, and $R_4$ is preferably a hydrogen atom $Y_1$ in the general formula (I) represents $$-\overset{O}{\overset{\|}{\underset{|}{P}}}- \text{ or } -\overset{|}{P}-.$$

$Y_1$ is preferably $$-\overset{O}{\overset{\|}{\underset{|}{P}}}-.$$

It is preferred that $R_1$, $R_2$, $L_1$ or $R_3$, particularly $R_1$ or $R_2$ contains a diffusion resistant group, i.e., a so-called ballast group, used for couplers. Such a ballast group has eight or more carbon atoms and comprises an alkyl group, a phenyl group, an ether group, an amido group, a ureido group, a urethane group, a sulfonamido group, a thioether group or a combination thereof.

It is also preferred that the compound represented by the general formula (I) has an adsorption accelerating group represented by the formula described below on the surface of silver halide in $R_1$, $R_2$, $L_1$ or $R_3$.

$$Y_2 \leftarrow L_3 \rightarrow_l$$

wherein $Y_2$ represents a adsorption accelerating group for silver halide; $L_3$ represents a divalent linkage group; and l represents 0 or 1.

Preferred examples of the adsorption accelerating group for silver halide represented by $Y_2$ include a thioamido group, a mercapto group, a group having a disulfido bond, or a 5-membered or 6-membered nitrogen-containing heterocyclic group.

The thioamido adsorption accelerating group represented by $Y_2$ is a divalent group represented by $$-\overset{S}{\overset{\|}{C}}\text{-amino-},$$

which may be a part of ring structure or an or an acylic thioamido group.

Useful thioamido adsorption accelerating groups are described, for example, in U.S. Pat. Nos. 4,030,925, 4,031,127, 4,080,207, 4,245,037, 4,255,511, 4,266,013 and 4,276,364, *Research Disclosure*, Vol. 151, No. 15162 (Nov., 1976) and *ibid.*, Vol. 176, No. 17626 (Dec., 1978).

Specific examples of the acyclic thioamido group include a thioureido group, a thiourethane group, and a dithiocarbamic acid ester group. Specific examples of the cyclic thioamido group include 4-thiazoline-2-thione, 4-imidazoline-2-thione, 2-thiohydantoin, rhodanine, thiocarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, and benzothiazoline-2-thione. They may be further substituted.

As the mercapto group represented by $Y_2$, there are an aliphatic mercapto group, an aromatic mercapto group, and a heterocyclic mercapto group (when the atom adjacent to the carbon atom bonded to -SH group is a nitrogen atom, the mercapto group has the same meaning as a cyclic thioamido group which is in a tautomeric relation therewith and specific examples thereof are same as illustrated above).

As the 5-membered or 6-membered nitrogen-containing heterocyclic group represented by $Y_2$, there are 5-membered or 6-membered nitrogen-containing heterocyclic rings comprises a combination of nitrogen, oxygen, sulfur, and carbon. Preferred examples thereof are benzotriazole, triazole, tetrazole, indazole, benzimidazole, imidazole, benzothiazole, thiazole, benzoxazole, oxazole, thiadiazole, oxadiazole, and triazine. They may be further substituted with an appropriate substituent.

The substituents can be selected from those described for $R_1$ or $R_2$.

$Y_2$ is preferably a cyclic thioamido group (for example, a mercapto-substituted nitrogen-containing heterocyclic ring, such as a 2-mercaptothiadiazole group, a 3-mercapto-1,2,4-triazole group, a 5-mercaptotetrazole group, a 2-mercapto-1,3,4-oxadiazole group, or a 2-mercaptobenzoxazole group) or a nitrogen-containing heterocyclic group (for example, a benzotriazole group, a benzimidazole group, or an indazole group).

Two or more $Y_2 \leftarrow L_3 \rightarrow_l$ groups may present in the compound and they may be the same or different.

The divalent linkage group represented by $L_3$ is an atom or an atomic group including at least one of a carbon atom, a nitrogen atom, a sulfur atom and an oxygen atom. More specifically, it includes an alkylene group, an alkenylene group, an alkynylene group, an arylene group, —O—, —S—, —NH—, —N=, —CO—, —$SO_2$—(these groups may be substituted), singly or as a combination thereof.

Specific examples of the divalent linkage group are set forth below.

—CONH—, —NHCONH—, —$SO_2$NH—, —COO—,

—NHCOO—, 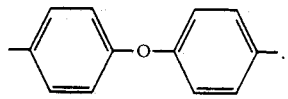

-continued

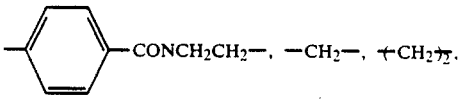

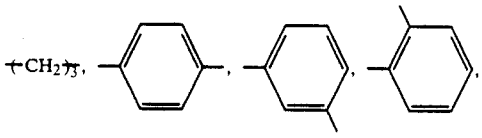

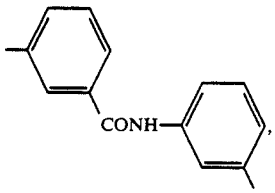

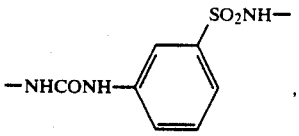

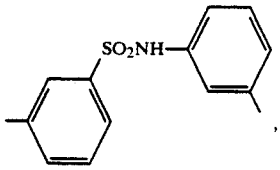

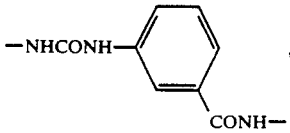

-continued

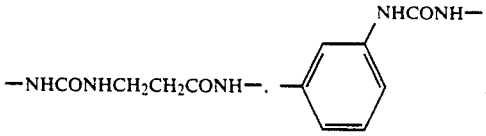

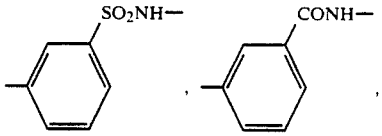

$-CH_2CH_2SO_2NH-$, $-CH_2CH_2CONH-$, $-PO_2NH-$.

These groups may be substituted with an appropriate substituent. The substituents can be selected from those described for $R_1$ or $R_2$.

Of the compounds represented by the general formula (I), those preferred are represented by the following general formula (Ia):

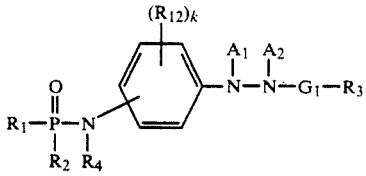

(Ia)

where $R_{12}$ has the same meaning as $R_1$ or $R_2$ in the general formula (I); k represents 0, 1 or 2; and $R_1$, $R_2$, $R_3$, $R_4$, $A_1$, $A_2$ and $G_1$ each has the same meaning as defined in the general formula (I).

The

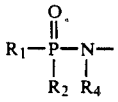

group is preferably present at the o- or p-position to the hydrazino group.

Specific examples of the compound represented by the general formula (I) are illustrated below but the invention should not be construed as being limited to these compounds.

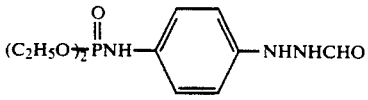

(I-1)

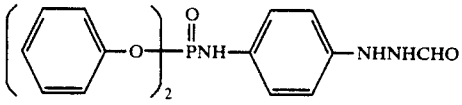

(I-2)

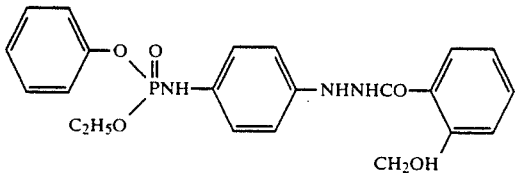

(I-3)

-continued
(I-4)
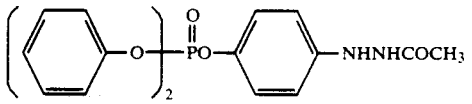
(I-5)
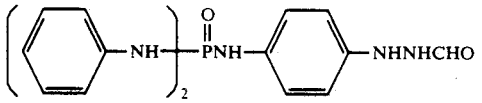
(I-6)
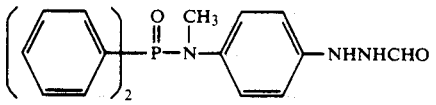
(I-7)
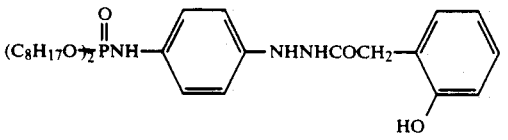
(I-8)
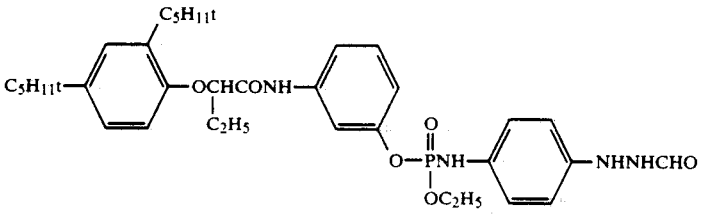
(I-9)
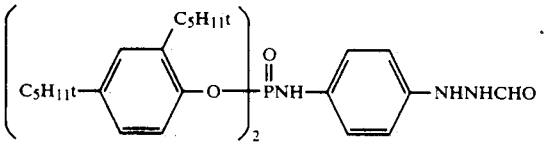
(I-10)
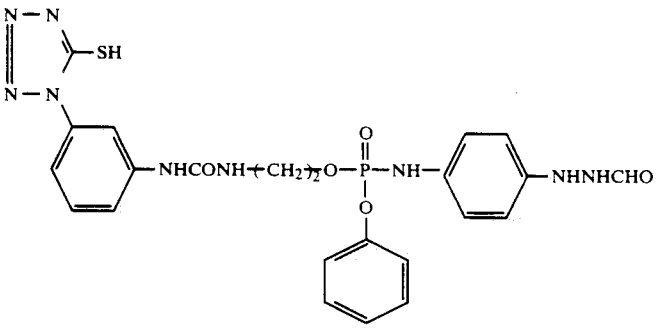
(I-11)
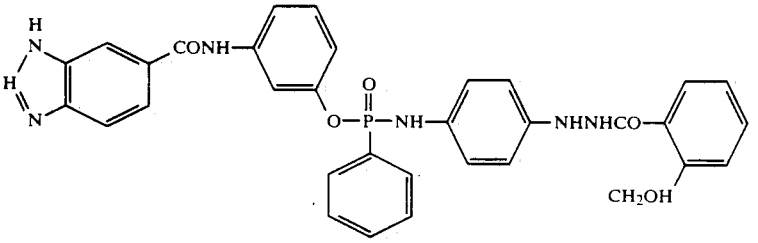

-continued
(I-12)
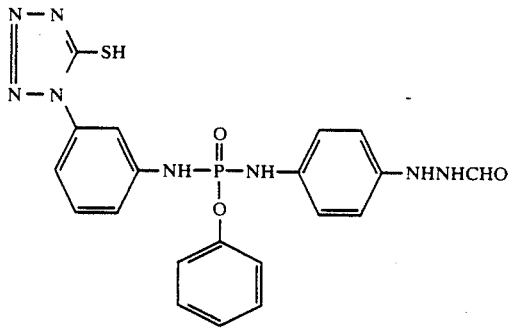
(I-13)
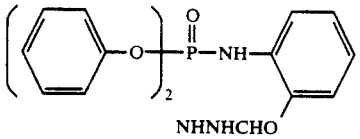
(I-14)
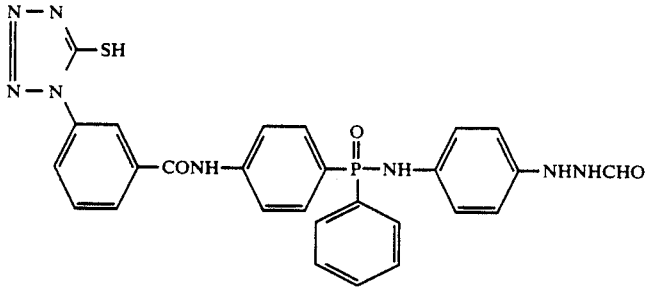
(I-15)
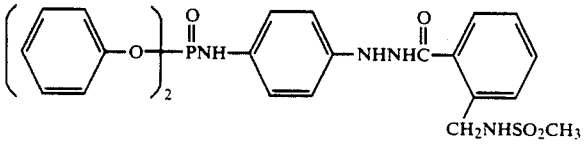
(I-16)
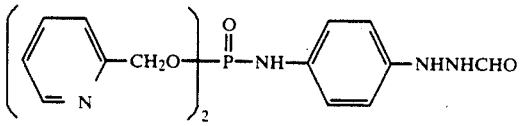
(I-17)
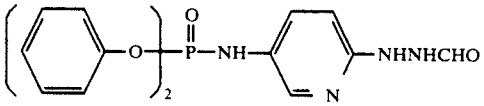
(I-18)
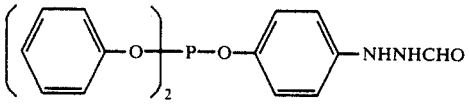
(I-19)
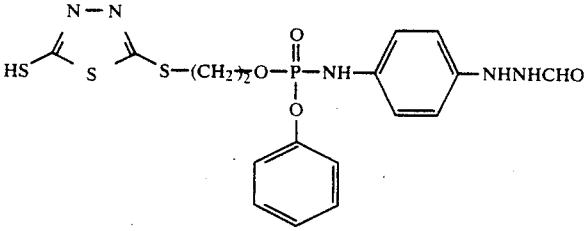

-continued (I-20)

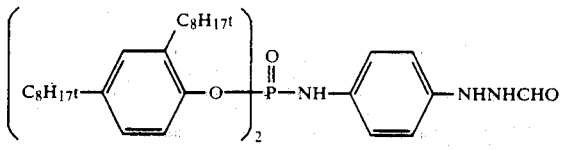

The compounds represented by the general formula (I) can be synthesized according to the methods as described, for example, in Gendai Yuki Gosei Series No. 5, *Yuki Rin Kagobutsu Orqanic Phosphorus Compounds)* edited by Shadanhojin Yuki Gosei Kagaku Kyokai, P. Brigl, H. Muller, *Ber.*, Vol. 72, p. 2121 (1939), V.V. Katyshkina, M. Ya. Kraft, Zh. Obshch. Vol. 26, p. 3060 (1956), *C. A.*, Vol. 51, p. 8028 (1957), H.D C.J. Worrel, F.X. Markley, *J. Am. Chem. Soc.*, Vol. 80, p. 727 (1958), G. Jacobsen, *Ber.*, Vol. 8, p. 1519 (1875), M. Rapp, *Ann.*, Vol. 224, p. 156 (1884), R. Heim, *Ber.*, Vol. 16, p. 1763 (1883), *Orq. Synth. Coll.*, Vol. 2, p. 110 (1943), A.E. Arbuzov, K.V. Nikonorov, *Zh. Obshch. Khim.*, Vol. 17, p. 2140 (1947), *C. A.*, Vol. 42, p. 4246b (1948), *Orq. Synth.*, Vol. 46, p. 42 (1965), R.M. Isham, U.S. Pat. No. 2,662,095 (1948), *C. A.*, Vol. 48, p. 13709f (1954), G.A. Saul, K.L. Godfrey, British Pat. No. 744,484 (1953), *C. A.*, Vol. 50, p. 16825c (1956), and H. Normant, *Anqew. Chem.*, Vol. 79, p. 1029 (1967)

Representative synthesis examples of the compounds represented by the general formula (I) are set forth below.

SYNTHESIS EXAMPLE 1

Synthesis of Compound I-2

7.6 g (0.05 mole) of 2-(4-aminophenyl)-1-formylhydrazine was dissolved in 25 ml of dimethylformamide and to the solution was added 10.4 ml (0.05 mole) of diphenylphosphorochloridate with thoroughly stirring in a nitrogen gas atmosphere. The mixture was cooled to reaction temperature of 10° C. or below, and 5.7 ml of methylmorpholine was gradually added dropwise thereto. After the completion of the addition, the reaction temperature was raised to about 20° C. and the mixture was stirred for 30 minutes. The reaction solution was poured into 400 ml of water, and extracted with ethyl acetate. The extract was dried with sodium sulfate and the ethyl acetate was distilled off. The residual oily product was isolated and purified by silica gel column chromatography (using dichloromethane/methanol=10/1) to obtain 8.9 g (yield: 46.6%) of Compound I-2 as an oily product.

SYNTHESIS EXAMPLE 2

Synthesis of Compound I-1

6.0 g (0.04 mole) of 2-(4-aminophenyl)-1-formylhydrazine was dissolved in 20 ml of acetonitrile and to the solution was added 5.8 ml (0.04 mole) of diethylphosphorochloridate with thoroughly stirring in a nitrogen gas atmosphere. The mixture was cooled to reaction temperature of 10° C or below and 4.6 ml (0.04 mole) of methylmorpholine was gradually added dropwise thereto. After the completion of the addition, the reaction temperature was raised to about 20° C. and the mixture was stirred for one hour. The reaction solution was filtered, the filtrate was concentrated under a reduced pressure. The residual oily product was isolated and purified by silica gel column chromatography (using ethyl acetate/methanol=4/1) to obtain 6.2 g (yield: 55.0%) of Compound I-1 as an oily product.

The nucleating agent used in the present invention can be incorporated into the photographic light-sensitive material or into a processing solution for the photographic light-sensitive material, and preferably is incorporated into the photographic lightsensitive material.

When the nucleating agent used in the present invention is incorporated into the photographic light-sensitive material, although it is preferably that it is added to an internal latent image type silver halide emulsion layer, it can be added to other layers such as an intermediate layer, a subbing layer or a backing layer so long as the nucleating agent diffuses during coating or processing to be adsorbed onto silver halide. When the nucleating agent is added to a processing solution, it can be added to a developing solution or a prebath having a low pH as described in JP-A-58-178350.

When the nucleating agent is incorporated into the photographic light-sensitive material, preferably the amount thereof is from $10^{-8}$ to $10^{-2}$ mol, more preferably from $10^{-7}$ to $10^{-3}$, per mol of silver halide contained in an emulsion layer.

When the nucleating agents is added to the processing solution, preferably the amount of the nucleating agents is from $10^{-5}$ to $10^{-1}$ mol, more preferably from $10^{-4}$ to $10^{-2}$ mol, per liter thereof.

The internal latent image type silver halide emulsion not having been previously fogged which can be used in the present invention includes an emulsion containing silver halide grains whose surfaces have not been previously fogged, and which form latent images predominantly internally. More specifically, suitable emulsions have the characteristic that when coated on a transparent support in a predetermined amount ranging from 0.5 g/m$^2$ to 3 g/m$^2$ in terms of silver, exposed for a fixed time between 0.01 and 10 seconds, then developed at 18° C. for 5 minutes in the following developing solution A (internal developer), a resulting maximum density (measured by a conventional photographic density measuring method) is at least about 5 times, more preferably at least about 10 times, as much as that obtained by coating and exposing the emulsion in the same manner as described above, but developing at 20° C. for 6 minutes in the following developing solution B (surface developer):

| | |
|---|---|
| Internal developer A | |
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water to make | 1 liter |
| Surface developer B | |
| Metol | 2.5 g |
| l-Ascorbic acid | 10 g |
| $NaBO_2.4H_2O$ | 35 g |
| KBr | 1 g |

-continued

| | |
|---|---|
| Water to make | 1 liter |

Specific examples of the internal latent image type emulsion include conversion type silver halide emulsions as described, for example, in U.S. Pat. No. 2,592,250, and core/shell type silver halide emulsions as described, for example, in U.S. Pat. Nos. 3,761,276, 3,850,637, 3,923,513, 4,035,185, 4,395,478 and 4,504,570, JP-A-52-156614, JP-A-55-127549, JP-A-53-60222, JP-A-56-22681, JP-A-59-208540, JP-A-61-3137, Japanese Pat. application No. 61-32462 (corresponding to JP-A-62-215272) and the patents cited in *Research Disclosure*, No. 23510 (Nov., 1983), p. 236.

The silver halide grains used in the present invention may be regular crystals such as cubic, octahedral, dodecahedral or tetradecahedral crystals, irregular crystals such as spherical crystals, or tabular grains whose length/thickness ratio is 5 or more. A composite form of these crystal forms may be used, and an emulsion made up of a mixture of these crystals may also be used.

The composition of the silver halide includes silver chloride, silver bromide or a mixed silver halides, and the silver halide preferably used in the present invention is either free from silver iodide, or if it contains a silver iodide, it is silver chloro(iodo)bromide, silver (iodo)-chloride or silver (iodo)bromide containing 3 mol% or less of silver iodide.

The average grain size of the silver halide grains is preferably from 0.1 μm up to 2 μm, more preferably from 0.15 μm to 1 μm. Although the distribution of the grain size may be wide or narrow, in order to improve graininess and sharpness, it is preferred in the present invention to use a so-called "monodisperse" silver halide emulsion having a narrow grain size distribution such that 90% or more of all the grains fall within the average grain size of ±40%, preferably ±20%, in terms of grain number or weight.

In order to satisfy the gradation required for the photographic light-sensitive material, in emulsion layers having substantially the same color sensitivity, two or more monodisperse silver halide emulsions different in grain size or a plurality of grains of the same size but different in sensitivity are mixed in the same layer or are applied as different layers that are superposed. Further, two or more polydisperse silver halide emulsions or a monodisperse silver halide emulsion and a polydisperse silver halide emulsion can be used in the form of a mixture or in superposed layers.

In the silver halide emulsion used in the present invention, the interior or the surface of the grains may be chemically sensitized by sulfur sensitization, selenium sensitization, reduction sensitization or noble metal sensitization, that can be used alone or in combination. Specific examples of useful chemical sensitization are described, for example, in the patents cited in *Research Disclosure*, No. 17643, Item III (Dec., 1978), page 23, etc.

The photographic emulsion used in the present invention is spectrally sensitized with a photographic sensitizing dye in a conventional manner. Particularly useful dyes are cyanine dyes, merocyanine dyes and complex merocyanine dyes, which may be used alone or in combination, and also can be used in combination with supersensitizers. Specific examples thereof are described, for example, in the patents cited in *Research Disclosure*, No. 17643, Item IV (Dec., 1978), pages 23 to 24.

The photographic emulsions used in the present invention can contain an antifoggant or a stabilizer for the purpose of stabilizing the photographic performance, or of preventing formation of fog during the production, storage or photographic processing of the photographic light-sensitive material. Specific examples of antifoggants and stabilizers are described, for example, in *Research Disclosure*, No. 17643, Item IV (Dec., 1978), and E.J Birr, *Stabilization of Photographic Silver Halide Emulsion*, 1974 (Focal Press).

In order to form direct positive color images according to the present invention, various color couplers can be employed. Useful color couplers are compounds that can undergo a coupling reaction with an oxidation product of an aromatic primary amine type color developing agent to produce or release a dye substantially non-diffusible and that themselves are preferably substantially non-diffusible. Typical examples of useful color couplers include naphtholic or phenolic compounds, pyrazolone or pyrazoloazole compounds and open chain or heterocyclic ketomethylene compounds. Specific examples of these cyan, magenta and yellow couplers which can be used in the present invention are compounds as described, for example, in *Research Disclosure*, No. 17643 (Dec., 1978), page 25, Item VII-D; *ibid.*, No. 18717 (Nov., 1979) and Japanese Pat. application No. 61-32462 (corresponding to JP-A-62-215272), and compounds described in the patents cited therein.

Colored couplers for correcting undesired absorption in the short wavelength range of produced dyes; couplers capable of forming dyes with appropriate diffusibility; colorless compound forming couplers; DIR couplers that can release a development inhibitor as a result of the coupling reaction; and polymerized couplers can also be used.

As binders or protective colloids which can be used in emulsion layers and intermediate layers of the photographic light-sensitive material of the present invention, it is advantageous to use gelatin, but other hydrophilic colloids than gelatin can also be used.

The photographic light-sensitive material in accordance with the present invention may contain a color fog preventing agent or color stain preventing agent. Representative examples of these compounds are described in JP-A-62-215272, pages 185 to 193.

In the present invention, a color formation reinforcing agent can be employed for the purpose of increasing a color forming property of coupler. Representative examples of such compounds are described in JP-A-62-215272, pages 121 to 125.

The photographic light-sensitive material of the present invention can contain dyes for preventing irradiation or halation, ultraviolet light absorbing agents, plasticizers, brightening agents, matting agents, aerial fog preventing agents, coating aids, hardening agents, antistatic agents, lubricants, etc. Typical examples of these additives are described in *Research Disclosure*, No. 17643, Items VIII to XIII (Dec., 1978), pages 25 to 27, *ibid.*, No. 18716 (Nov., 1979), pages 647 to 651.

The present invention can be applied to multilayer multicolor photographic materials having at least two layers having different spectral sensitivities on a support. Generally, a multilayer natural color photographic material has at least one red-sensitive emulsion layer, at least one green-sensitive emulsion layer and at least one blue-sensitive emulsion layer on a support. The order of these layers is appropriately selected as desired. In a preferred order of the layers, a red-sensitive emulsion layer, a green-sensitive emulsion layer and a blue-sensitive emulsion layer are coated in that order on a support or a green-sensitive emulsion layer, a red-sensitive emulsion layer and a blue-sensitive emulsion layer are coated in that order on a support. Each of these emulsion layers may consist of two or more emulsion layers different in sensitivity, or may consist of two or more emulsion layers having the same sensitivity with a light-insensitive layer between them. Generally, the red-sensitive emulsion layer contains a cyan forming coupler, the green-sensitive emulsion layer contains a magenta forming coupler and the blue-sensitive emulsion layer contains a yellow forming coupler, but in some cases the combination can be changed.

It is preferable that the photographic light-sensitive material according to the present invention is provided with suitable auxiliary layers such as a protective layer, an intermediate layer, a filter layer, an antihalation layer, a backing layer and a white reflective layer, in addition to the silver halide emulsion layers.

In the photographic light-sensitive materials of the present invention, the photographic emulsion layers and other layers are applied on a support as described in *Research Disclosure*, No. 17643, Item XVII (Dec., 1978), page 28, European Pat. No. 0,102,253, and JP-A-61-97655. The coating methods as described in *Research Disclosure*, No. 17643, Item XV, pages 28 to 29 can be employed.

The present invention may be applied to various types of color photographic light-sensitive materials.

For instance, color reversal films for slides and television, color reversal papers, instant color films, etc. are typical examples. In addition, the present invention may be applied to color hard copies for preserving images of full color copiers or CRT. The present invention is also applicable to black-and-white photographic light-sensitive materials utilizing mixing of three color couplers, as described, for example, in *Research Disclosure*, No. 17123 (July, 1978).

Furthermore, the present invention can be applied to black-and-white photographic light-sensitive materials. Examples of the black-and-white (B/W) photographic light-sensitive materials to which can be applied the present invention include B/W direct positive photographic light-sensitive materials (for example, photographic materials for X-ray, for duplication, for micrography, for photocomposing, and for printing) as described, for example, in JP-A-59-208540 and JP-A-60-260039.

It is preferred to employ a nucleation accelerating agent together with the above described nucleating agent in the present invention.

The term "nucleation accelerating agent" as used herein means a substance which does not substantially act as the nucleating agent but, rather, acts to accelerate the action of the nucleating agent to increase the maximum density of direct positive images and/or reduce the development time required to provide a predetermined direct positive image density.

As the nucleation accelerating agent, a compound represented by the general formula (II) or (III) described below, is preferably employed.

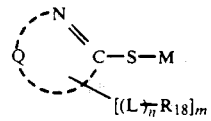

(II)

wherein Q represents an atomic group necessary to form a 5-membered or 6-membered heterocyclic ring to which a carbocyclic aromatic ring or a heterocyclic aromatic ring may further be condensed; L represents a divalent linkage group comprising an atom or atomic group selected from the group consisting of a hydrogen atom, a carbon atom, a nitrogen atom, an oxygen atom, and a sulfur atom; $R_{18}$ represents an organic group containing at least one of a thioether group, an amino group, an ammonium group, an ether group, or a heterocyclic group; n represents 0 or 1; m represents 0, 1 or 2; and M represents a hydrogen atom, an alkali metal atom, an ammonium group or a group capable of being cleaved under an alkaline condition,

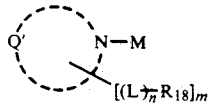

(III)

wherein Q' represents an atOmic group necessary to form a 5-membered or 6-membered heterocyclic ring which is capable of forming imino silver; L, $R_{18}$, n and M each has the same meaning as defined in the general formula (II) above; and m represents 1 or 2.

$[(L)_n R_{18}]_m$ also has the same meaning as defined in the general formula (II) aboVe.

Now, the compound represented by the general formula (II) or (III) will be explained in detail.

In the general formula (II), Q preferably represents an atomic group necessary to form a 5-membered or 6-membered heterocyclic ring comprising at least one atom selected from the group consisting of a carbon atom, a nitrogen atom, an oxygen atom, a sulfur atom and a selenium atom. The heterocyclic ring may be condensed with a carbocyclic aromatic ring or heterocyclic aromatic ring.

Examples of the heterocyclic ring include a tetrazole, a triazole, an imidazole, a thiadiazole, an oxadiazole, a selenadiazole, an oxazole, a thiazole, a benzoxazole, a benzothiazole, a benzimidazole, and a pyrimidine.

M represents a hydrogen atom, an alkali metal atom (for example, sodium, or potassium), an ammonium group (for example, trimethylammonium, or dimethylbenzylammonium) or a group which undergoes cleavage under an alkaline condition to become a hydrogen atom or an alkali metal atom for M (for example, acetyl, cyanoethyl, or methanesulfonylethyl).

The above described heterocyclic ring may be substituted with a nitro group, a halogen atom (for example, chlorine, or bromine), a mercapto group, a cyano group, a substituted or unsubstituted alkyl group (for example, methyl, ethyl, propyl, tert-butyl, cyanoethyl), a substituted or unsubstituted aryl group (for example, phenyl, 4-methanesulfonamidophenyl, 4-methylphenyl, 3,4-dichlorophenyl, naphthyl), a substituted or unsubstituted alkenyl group (for example, allyl), a substituted or unsubstituted aralkyl group (for example, benzyl, 4-methylbenzyl, phenethyl), a sulfonyl group (for example, methanesulfonyl, ethanesulfonyl, p-toluenesulfonyl), a carbamoyl group (for example, unsubstituted carbamoyl, methylcarbamoyl, phenylcarbamoyl), a sulfamoyl group (for example, unsubstituted sulfamoyl, methylsulfamoyl, phenylsulfamoyl), a carbonamido group (for example, acetamido, benzamido), a sulfonamido group (for example, methanesulfonamido, benzenesulfonamido, p-toluenesulfonamido), an acyloxy group (for example, acetyloxy, benzoyloxy), a sulfonyloxy group (for example, methanesulfonyloxy), a ureido group (for example, unsubstituted ureido, methylureido, ethylureido, phenylureido), a thioureido group (for example, unsubstituted thioureido, methylthioureido), an acyl group (for example, acetyl, benzoyl), an oxycarbonyl group (for example, methoxycarbonyl, phenoxycarbonyl), an oxycarbonylamino group (for example, methoxycarbonylamino, phenoxycarbonylamino, 2-ethylhexyloxycarbonylamino), a carboxylic acid or a salt thereof, a sulfonic acid or a salt thereof, or a hydroxy group. However, the heterocyclic ring preferably is not substituted with a carboxylic acid or a salt thereof, a sulfonic acid or a salt thereof, or a hydroxy group in view of the effect of accelerating nucleation.

Preferred examples of the heterocyclic ring represented by Q include a tetrazole, a triazole, an imidazole, a thiadiazole, and an oxadiazole.

L represents a divalent linkage group comprising an atom or atomic group selected from the group consisting of a hydrogen atom, a carbon atom, a nitrogen atom, an oxygen atom and a sulfur atom. Suitable examples of the divalent linkage group include -S-, -0-,

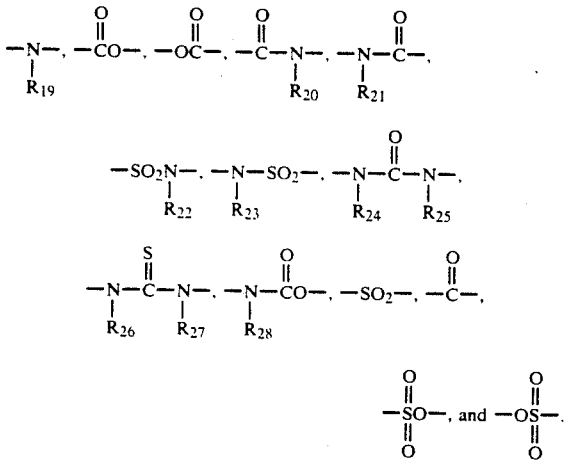

In the above formulae, $R_{19}$, $R_{20}$, $R_{21}$, $R_{22}$, $R_{23}$, $R_{24}$, $R_{25}$, $R_{26}$, $R_{27}$ and $R_{28}$ each represents a hydrogen atom, a substituted or unsubstituted alkyl group (for example, methyl, ethyl, propyl, n-butyl), a substituted or unsubstituted aryl group (for example, phenyl, 2-methylphenyl), a substituted or unsubstituted alkenyl group (for example, propenyl, 1-methylvinyl), or a substituted or unsubstituted aralkyl group (for example, benzyl, phenethyl).

These linkage groups may be connected through a straight chain or branched chain alkylene group (for example, methylene, ethylene, propylene, butylene, hexylene, 1-methylethylene) or a substituted or unsubstituted arylene group (for example, phenylene, naphthylene) to a heterocyclic ring described below.

$R_{18}$ in the general formula (II) or (III) represents an organic group containing at least one of a thioether group, an amino group (including a salt thereof), an ammonium group, an ether group or a heterocyclic group (including a salt thereof).

Suitable examples of the organic group include groups obtained by combining a group selected from a substituted or unsubstituted alkyl group a substituted or unsubstituted alkenyl group, a substituted or unsubstituted aralkyl group, and a substituted or unsubstituted aryl group with a thioether group, an amino group, an ammonium group, an ether group, or a heterocyclic group above. Combinations of such organic groups may be used. Specific examples of such organic groups include a dimethylaminoethyl group, an aminoethyl group, a diethylaminoethyl group, a dibutylaminoethyl group, a dimethylaminopropyl hydrochloride group, a dimethylaminoethylthioethyl group, a 4-dimethylaminophenyl group, a 4-dimethylaminobenzyl group, a methylthioethyl group, an ethylthiopropyl group, a 4-methylthio-3-cyanophenyl group, a methylthiomethyl group, a trimethylammonioethyl group, a methoxyethyl group, a methoxyethoxyethoxyethyl group, a methoxyethylthioethyl group, a 3,4-dimethoxyphenyl group, a 3-chloro-4-methoxyphenyl group, a morpholinoethyl group, a 1-imidazolylethyl group, a morpholinoethylthioethyl group, a pyrrolidinoethyl group, a piperidinopropyl group, a 2-pyridylmethyl group, a 2-(1-imidazolyl)ethyl-thioethyl group, a pyrazolylethyl group, a triazolylethyl group, and a methoxyethoxyethoxyethoxycarbonylaminoethyl group.

In the general formula (II), n represents 0 or 1, and m represents 0, 1 or 2.

In the general formula (III), L, $R_{18}$, n and M each has the same meaning as defined in the genera) formula (ii); m represents 1 or 2; and Q' represents an atomic group necessary to form a 5-membered or 6-membered heterocyclic ring which is capable of forming imino silver, preferably an atomic group necessary to form a 5-membered or 6-membered heterocyclic ring comprising at least one atom selected from the group consisting of a carbon atom, a nitrogen atom, an oxygen atom, a sulfur atom and a selenium atom. The heterocyclic ring may be condensed with a carbocyclic aromatic ring or heterocyclic aromatic ring.

Suitable examples of the heterocyclic ring formed by Q' include an indazole, a benzimidazole, a benzotriazole, a benzoxazole, a benzothiazole, an imidazole, a thiazole, an oxazole, a triazole, a tetrazole, a tetraazaindene, a triazaindene, a diazaindene, a pyrazole, and an indole.

Of the compounds represented by the general formula (II), those represented by the general formula (IV), (V), (VI), or (VII) described below are preferably employed.

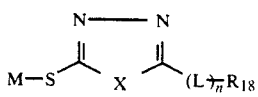

(IV)

wherein M, $R_{18}$, L and n each has the same meaning as defined in the general formula (II); and X represents an oxygen atom, a sulfur atom or a selenium atom, preferably a sulfur atom,

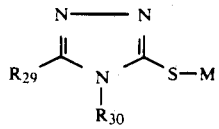

(V)

wherein R29 represents a hydrogen atom, a halogen atom (for example, chlorine, bromine), a nitro group, a mercapto group, an unsubstituted amino group, a substituted or unsubstituted alkyl group (for example, methyl, ehtyl), a substituted or unsubstituted alkenyl group (for example, propenyl, 1- methylvinyl), a substituted or unsubstituted aralkyl group (for example, benzyl, phenethyl), a substituted or unsubstituted aryl group (for example, phenyl, 2-methylphenyl) or $(L\rightarrow_n R_{18}$; $R_{30}$ represents a hydrogen atom, an unsubstituted amino group or $(L\rightarrow_n R_{18}$, when both $R_{29}$ and $R_{30}$ represent $(L\rightarrow_n R_{18}$, they may be the same or different, provided that at least one of $R_{29}$ and $R_{30}$ represents $(L\rightarrow_n R_{18}$; and M, $R_{18}$, L and n each has the same meaning as defined in the general formula (II),

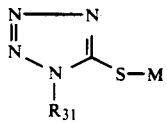

(VI)

wherein $R_{31}$ represents $(L\rightarrow_n R_{18}$; and M, $R_{18}$, L and n each has the same meaning as defined in the general formula (II),

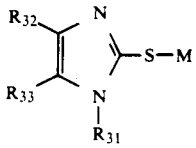

(VII)

wherein $R_{32}$and $R_{33}$, which may be the same or different, each represents a hydrogen atom, a halogen atom, a substituted or unsubstituted amino group, a nitro group, a substituted or unsubstituted alkyl group, a substituted or unsubstituted alkenyl group, a substituted or unsubstituted aralkyl group or a substituted or unsubstituted aryl group; M and $R_{31}$ each has the same meaning as defined in the general formula (VI).

Specific examples of the compound represented by the general formulae (III) to (VII) will be set forth hereinafter, but the present invention should not be construed as being limited thereto.

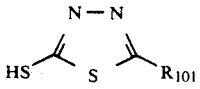

| No. | $R_{101}$ |
|---|---|
| A-1. | $-SCH_3$ |
| A-2. | $-S(CH_2)_3N(CH_3)_2.HCl$ |
| A-3. | 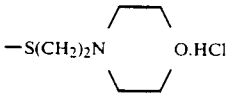 |
| A-4. | $-S(CH_2)_2OCH_3$ |
| A-5. | $-SCH_2SCH_3$ |

-continued

| | |
|---|---|
| A-6. | $-S(CH_2)_6N(CH_3)_2.HCl$ |
| A-7. | $-S(CH_2)_6N(C_2H_5)_2.HCl$ |
| A-8. | $-S(CH_2)_2S(CH_2)_2N(CH_3)_2.HCl$ |
| A-9. | 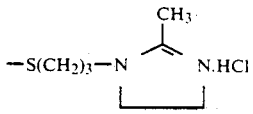 |
| A-10. | $-S(CH_2)_2\overset{\oplus}{N}(CH_3)_3.Cl^{\ominus}$ |
| A-11. | $-S(CH_2)_2NHCH_3.HCl$ |

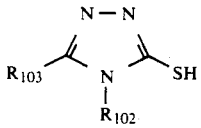

| No. | $R_{102}$ | $R_{103}$ |
|---|---|---|
| A-12. | 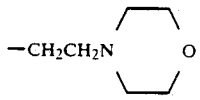 | H |
| A-13. | $-CH_3$ | H |
| A-14. | 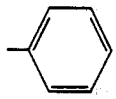 | H |
| A-15. | $-CH_2CH_2N(C_2H_5)_2$ | H |
| A-16. | $-CH_2CH_2N(CH_3)_2$ | H |
| A-17. | $-CH_3$ | $CH_3OCH_2$ |
| A-18. | 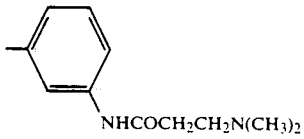 | H |
| A-19. | 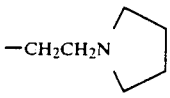 | H |
| A-20. | 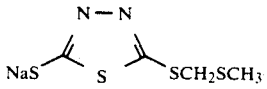 | |
| A-21. | 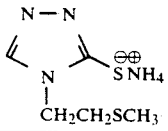 | |

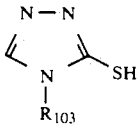

| No. | $R_{103}$ |
|---|---|
| A-22. | $-(CH_2)_2S(CH_2)_2N(CH_3)_2$ |
| A-23. | $-(CH_2)_2N(C_3H_7\text{-}n)_2$ |
| A-24. | $-(CH_3)_3N(CH_3)_2$ |
| A-25. | $-(CH_2)_2\overset{\oplus}{N}(CH_3)_3.Cl^{\ominus}$ |

-continued

A-26.

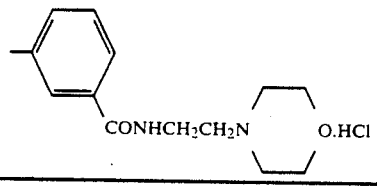

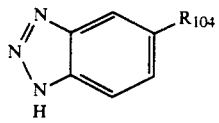

| No. | $R_{104}$ |
|---|---|
| A-27. | $-OCNH(CH_2)_2N(CH_3)_2$ |
| A-28. | $-OCNH(CH_2)_2SCH_3$ |

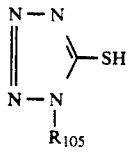

| No. | $R_{105}$ |
|---|---|
| A-29. | $-CH_3$ |
| A-30. | $-(CH_2)_2N(C_3H_{7-n})_2$ |
| A-31. | $-(CH_2)_2N(C_2H_5)_2$ |
| A-32. | $-(CH_2)_2CH_3$ |

A-33.

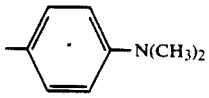

A-34.

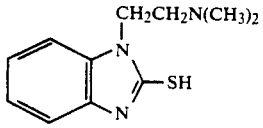

The nucleation acclerating agent described above used in the present invention is incorporated into the photographic light-sensitive material or a processing solution, and preferably incorporated into an internal latent image type silver halide emulsion layer or other hydrophilic colloid layer (for example, an intermediate layer or a protective layer). Particularly preferably, the nucleation accelerating agent is incorporated into a silver halide emulsion layer or an adjacent layer thereto.

The amount of the nucleation accelerating agent added is preferably from $10^{-6}$ to $10^{-2}$ mol, more preferably from $10^{-5}$ to $10^{-2}$ mol per mol of silver halide.

When the nucleation accelerating agent is added to the processing solution, specifically a developing solution or a prebath thereof, the amount added is preferably from $10^{-8}$ to $10^{-3}$ mol, more preferably from $10^{-7}$ to $10^{-4}$ mol, per liter thereof.

A color developing solution which can be used in development processing of the photographic light-sensitive material according to the present invention is an alkaline aqueous solution containing preferably an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-8-hydroxyethylaniline, 3-methyl-4-amino-N-ethyl-N-8-methanesulfonamidoethylaniline, 3-methyl-4-amino-N-ethyl-N-8-methoxyethylanili or sulfate, hydrochloride, p-toluenesulfonate thereof.

Two or more kinds of color developing agents may be employed in a combination thereof, depending on the purpose.

The pH of the color developing solution used is ordinarily in a range from 9.0 to 12.0, preferably in a range from 9.5 to 11.5, most preferably in a range from 9.8 to 11.0.

After color development, the photographic emulsion layers are usually subjected to a bleach processing. The bleach processing can be performed simultaneously with a fix processing (bleach-fix processing), or it can be performed independently from the fix processing. Further, for the purpose of performing a rapid processing, a processing method wherein after a bleach processing a bleach-fix processing is conducted may be employed. Moreover, it may be appropriately practiced depending on the purpose to process using a continuous two tank bleach-fixing bath, to carry out fix processing before bleach-fix processing, or to conduct bleach processing after bleach-fix processing.

After a desilvering step, the silver halide color photographic material according to the present invention is generally subjected to a water washing step and/or a stabilizing step.

An amount of water required for the water washing step may be set in a wide range depending on characteristics of photographic light-sensitive materials (due to elements used therein, for example, couplers), uses thereof, temperature of washing water, a number of water washing tanks (stages), a replenishment system such as countercurrent or orderly current, or other various conditions. A relationship between a number of water washing tanks and an amount of water in a multistage countercurrent system can be determined based on the method as described in *Journal of the Society of Motion Picture and Television Engineers*, Vol. 64, pages 248 to 253 (May, 1955).

For the purpose of simplification and acceleration of processing, a color developing agent may be incorporated into the silver halide color photographic material according to the present invention. In order to incorporate the color developing agent, it is preferred to employ various precursors of color developing agents.

In order to develop the black-and-white photographic light-sensitive material, known various developing agents can be employed in the present invention. For instance, polyhydroxybenzenes, for example, hydroquinone, 2-chlorohydroquinone, 2-methylhydroquinone, catechol, and pyrogallol; aminophenols, for example, p-aminophenol, N-methyl-p-aminophenol, and 2,4-diaminophenol; 3-pyrazolidones, for example, 1-phenyl-3-pyrazolidone, 1-phenyl-4,4-dimethyl-3-pyrazolidone, 1-phenyl-4-methyl-4-hydroxymethyl-3-pyrazolidone, and 5,5-dimethyl-1-phenyl-3-pyrazolidone; and ascorbic acids; are employed individually or in a combination. Further, a developing solution as described in JP-A-58-55928 may be employed. Such developing agents may be incorporated into an alkaline processing composition (processing element) or an appropriate layer of a light-sensitive element.

The developing solution may contain sodium sulfite, potassium sulfite, ascorbic acid, or a reductone (for example, piperidinohexose reductone) as a preservative.

The photographic light-sensitive material according to the present invention can provide direct positive images upon development using a surface developing solution. The surface developing solution has a property in that its development process is substantially inverted by a latent image or a fog center positioned on the surface of silver halide grain. Although it is preferred that the surface developing solution does not contain a silver halide solvent, the surface developing solution may contain a silver halide solvent such as sulfite, as far as an internal latent image does not substantially contribute until the development due to the development center positioned on the surface of silver halide grain is completed.

The developing solution may contain sodium hydroxide, potassium hydroxide, sodium carbonate, potassium carbonate, trisodium phosphate, or sodium metaborate, as an alkali agent or a buffering agent. The amount of these agents is selected so that the pH of the developing solution is adjusted to a range from 9.0 to 12.0, preferably from 9.5 to 11.5.

It is advantageous that the developing solution may further contain a compound which is usually employed as an antifoggant, for example, a benzimidazole such as 5-nitrobenzimidazole, a benzotriazole such as benzotriazole, or 5-methylbenzotriazole, in order to reduce a minimum density of direct positive image.

Specific examples and methods for use of developing agents, preservatives, buffering agents and methods of development with respect to black-and-white photographic light-sensitive materials are described, for example, in *Research Disclosure*, No. 17643 (Dec., 1978), Items XIX to XXI.

In accordance with the present invention, positive images having a high maximum image density and a low minimum image density can be formed by processing a direct positive photographic light-sensitive material.

In any magenta, cyan and yellow color images, high maximum image densities and low minimum image densities are obtained. This effect is obtained in a case of developing processing at a pH of 11.5 or below. Still higher maximum image density is obtained by coexisting with a nucleation accelerating agent in such a case.

Further, the formation of image can be stably performed according to the image forming method of the present invention even if direct positive photographic light-sensitive materials are preserved under high temperature and high humidity conditions.

The present invention is now illustrated in greater detail with reference to the following examples, but the present invention is not to be construed as being limited thereto.

EXAMPLE 1

The following First layer to Fourteenth layer were coated on the front side of a paper support (having a thickness of 100 μm), both surfaces of which were laminated with polyethylene, and the following Fifteenth layer to Sixteenth layer were coated on the back side of the paper support to prepare a color photographic light-sensitive material. The polyethylene laminated on the First layer side of the support contained titanium dioxide as a white pigment and a slight amount of ultramarine as a bluish dye (chromaticity of the surface of the support was 88.0, −0.20 and −0.75 in an L*, a* and b* system).

Construction of Layers

The composition of each layer is shown below. The coating amounts of the components are described in the unit of g/m². With respect to silver halide, the coating amount is indicated in terms of a silver coating amount. The emulsion used in each layer was prepared according to the method for preparation of Emulsion EM1. The emulsion used in the Fourteenth layer was a Lippmann emulsion not being chemically sensitized on the surfaces of grains.

| | |
|---|---|
| First Layer: Antihalation Layer | |
| Black colloidal silver | 0.10 |
| Gelatin | 0.70 |
| Second Layer: Intermediate Layer | |
| Gelatin | 0.70 |
| Third Layer: Low-Sensitive Red-Sensitive Layer | |
| Silver bromide emulsion spectrally sensitized with red-sensitizing dyes (ExS-1, 2, 3) (average grain size: 0.25 μm, size distribution (coefficient of variation): 8%, octahedral) | 0.04 |
| Silver chlorobromide emulsion spectrally sensitized with red-sensitizing dyes (ExS-1, 2, 3) (silver chloride: 5 mol %, average grain size: 0.40 μm, size distribution: 10%, octahedral) | 0.08 |
| Gelatin | 1.00 |
| Cyan coupler (ExC-1, 2, 3, mixing ratio: 1/1/0.2) | 0.30 |
| Discoloration inhibitor (Cpd-1, 2, 3, 4, mixing ratio: 1/1/1/1) | 0.18 |
| Stain preventing agent (Cpd-5) | 0.003 |
| Coupler dispersing medium (Cpd-6) | 0.03 |
| Coupler solvent (Solv-1, 2, 3, mixing ratio: 1/1/1) | 0.12 |
| Fourth Layer: High-Sensitive Red-Sensitive Layer | |
| Silver bromide emulsion spectrally sensitized with red-sensitizing dyes (ExS-1, 2, 3) (average grain size: 0.60 μm, size distribution: 15%, octahedral) | 0.14 |
| Gelatin | 1.00 |
| Cyan coupler (ExC-1, 2, 3, mixing ratio: 1/1/0.2) | 0.30 |
| Discoloration inhibitor (Cpd-1, 2, 3, 4, mixing ratio: 1/1/1/1) | 0.18 |
| Coupler dispersing medium (Cpd-6) | 0.03 |
| Coupler solvent (Solv-1, 2, 3, mixing ratio: 1/1/1) | 0.12 |
| Fifth Layer: Intermediate Layer | |
| Gelatin | 1.00 |
| Color stain preventing agent (Cpd-7) | 0.08 |
| Color stain preventing agent solvent (Solv-4, 5, mixing ratio: 1/1) | 0.16 |
| Polymer latex (Cpd-8) | 0.10 |
| Six Layer: Low-Sensitive Green-Sensitive Layer | |
| Silver bromide emulsion spectrally sensitized with green-sensitizing dye (ExS-4) (average grain size: 0.25 μm, size distribution: 8%, octahedral) | 0.04 |
| Silver chlorobromide emulsion spectrally sensitized with green-sensitizing dye (ExS-4) (silver chloride: 5 mol %, average grain size: 0.40 μm, size distribution: 10%, octahedral) | 0.06 |
| Gelatin | 0.80 |
| Magenta coupler (ExM-1, 2, 3, mixing ratio: 1/1/1) | 0.11 |
| Discoloration inhibitor (Cpd-9, 26, mixing ratio: 1/1) | 0.15 |
| Stain preventing agent (Cpd-10, 11, 12, 13, mixing ratio: 10/7/7/1) | 0.025 |
| Coupler dispersing medium (Cpd-6) | 0.05 |

-continued

| | |
|---|---|
| Coupler solvent (Solv-4, 6, mixing ratio: 1/1) | 0.15 |
| Seventh Layer: High-Sensitive Green-Sensitive Layer | |
| Silver bromide emulsion spectrally sensitized with green-sensitizing dye (ExS-4) (average grain size: 0.65 μm, size distribution: 16%, octahedral) | 0.10 |
| Gelatin | 0.80 |
| Magenta coupler (ExM-1, 2, 3, mixing ratio: 1/1/1) | 0.11 |
| Discoloration inhibitor (Cpd-9, 25, mixing ratio: 1/1) | 0.15 |
| Stain preventing agent (Cpd-10, 11, 12, 13, mixing ratio: 10/7/7/1) | 0.025 |
| Coupler dispersing medium (Cpd-6) | 0.05 |
| Coupler solvent (Solv-4, 6, mixing ratio: 1/1) | 0.15 |
| Eighth Layer: Intermediate Layer | |
| Same as Fifth Layer | |
| Ninth Layer: Yellow Filter Layer | |
| Yellow colloidal silver | 0.12 |
| Gelatin | 0.70 |
| Color stain preventing agent (Cpd-7) | 0.03 |
| Color stain preventing agent solvent (Solv-4, 5, mixing ratio: 1/1) | 0.10 |
| Polymer latex (Cpd-8) | 0.07 |
| Tenth Layer: Intermediate Layer | |
| Same as Fifth Layer | |
| Eleventh Layer: Low-Sensitive Blue Sensitive Layer | |
| Silver bromide emulsion spectrally sensitized with blue-sensitizing dyes (ExS-5, 6) (average grain size: 0.40 μm, size distribution: 8%, octahedral) | 0.07 |
| Silver chlorobromide emulsion spectrally sensitized with blue-sensitizing dyes (ExS-5, 6) (silver chloride: 8 mol %, average grain size: 0.60 μm, size distribution: 11%, octahedral) | 0.14 |
| Gelatin | 0.80 |
| Yellow coupler (ExY-1, 2, mixing ratio: 1/1) | 0.35 |
| Discoloration inhibitor (Cpd-14) | 0.10 |
| Stain preventing agent (Cpd-5, 15, mixing ratio: 1/5) | 0.007 |
| Coupler dispersing medium (Cpd-6) | 0.05 |
| Coupler solvent (Solv-2) | 0.10 |
| Twelfth Layer: High-Sensitive Blue-Sensitive Layer | |
| Silver bromide emulsion spectrally sensitized with blue-sensitizing dyes (ExS-5, 6) (average grain size: 0.85 μm, size distribution: 18%, octahedral) | 0.15 |
| Gelatin | 0.60 |
| Yellow coupler (ExY-1, 2: mixing ratio: 1/1) | 0.30 |
| Discoloration inhibitor (Cpd-14) | 0.10 |
| Stain preventing agent (Cpd-5, 15, mixing ratio: 1/5) | 0.007 |
| Coupler dispersing medium (Cpd-6) | 0.05 |
| Coupler solvent (Solv-2) | 0.10 |
| Thirteenth Layer: Ultraviolet Light Absorbing Layer | |
| Gelatin | 1.00 |
| Ultraviolet light absorbing agent (Cpd-2, 4, 16, mixing ratio: 1/1/1) | 0.50 |
| Color stain preventing agent (Cpd-7, 17, mixing ratio: 1/1) | 0.03 |
| Dispersing medium (Cpd-6) | 0.02 |
| Ultraviolet light absorbing agent solvent (Solv-2, 7 mixing ratio: 1/1) | 0.08 |
| Irradiation preventing dye (Cpd-18, 19, 20, 21, 22, mixing ratio: 10/10/13/15/20) | 0.05 |

-continued

| | |
|---|---|
| Fourteenth Layer: Protective Layer | |
| Silver chlorobromide fine particles (silver chloride: 97 mol %, average grain size: 0.1 μm) | 0.03 |
| Acryl-modified copolymer of polyvinyl-alcohol | 0.01 |
| Polymethyl methacrylate particles (average particle size: 2.4 μm) and silicon oxide (average particle size: 5 μm), mixing ratio: 1/1 | 0.05 |
| Gelatin | 1.80 |
| Gelatin hardener (H-1, 2; mixing ratio: 1/1) | 0.18 |
| Fifteenth Layer: Back Layer | |
| Gelatin | 2.50 |
| Ultraviolet light absorbing agent (Cpd-2, 4, 16, mixing ratio: 1/1/1) | 0.50 |
| Dye (Cpd-18, 19, 20, 21, 22, mixing ratio: 1/1/1/1/1) | 0.06 |
| Sixteenth Layer: Back Protective Layer | |
| Polymethyl methacrylate particles (average particle size: 2.4 μm) and silicon oxide (average particle size: 5 μm), mixing ratio: 1/1 | 0.05 |
| Gelatin | 2.00 |
| Gelatin hardener (H-1, 2, mixing ratio: 1/1) | 0.14 |

Preparation of Emulsion EM-1

An aqueous solution of potassium bromide (0.12N, 900 ml) and an aqueous solution of silver nitrate (0.12N, 830 ml) were added simultaneously to an aqueous gelatin solution (3%, 700 ml) at 75° C. over a period of 15 minutes while vigorously stirring, to obtain an octahedral silver bromide emulsion having an average grain diameter of 0.40 μm. 0.3 g of 3,4-dimethyl-1,3-thiazoline-2-thione, 6 mg of sodium thiosulfate and of chloroauric acid (tetrahydrate) were added to the emulsion per mol of silver in order and the emulsion was heated to 75° C. for 80 minutes to be chemically sensitized. The thus-prepared silver bromide grains were used as cores and were further grown under the same precipitation conditions as above to obtain finally a monodisperse octahedral core/shell type silver bromide emulsion having an average grain diameter of 0.7 μm. The coefficient of variation of the grain size was about 10%.

1.5 mg of sodium thiosulfate and 1.5 mg of chloroauric acid (tetrahydrate) were added to the emulsion per mol of silver, and the emulsion was heated to 60° C. for 60 minutes to be chemically sensitized, thus an internal latent image type silver halide emulsion was obtained.

To each light-sensitive layer, a nucleating agent was added as shown in Table 1 below.

Also, to each layer, as emulsifying dispersing aids, Alkanol XC (manufactured by Du Pont) and sodium alkylbenzenesulfonate, and as coating aids, succinic acid ester and Magefac F-120 (manufactured by Dai Nippon Ink and Chemical Co, Ltd.) were added. Furthermore, to the layers containing silver halide or colloidal silver, Stabilizers (Cpd-23, 24, 25) were added.

The compounds used in this example are illustrated below.

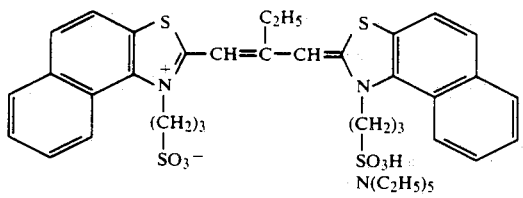
ExS-1
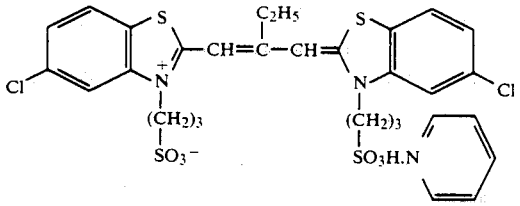
ExS-3
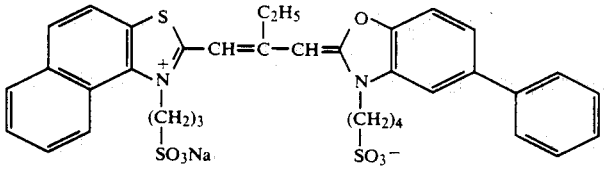
ExS-4
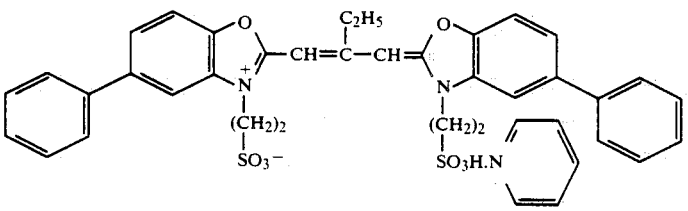
ExS-5
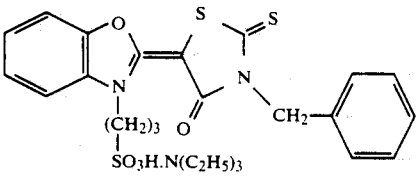
ExS-6
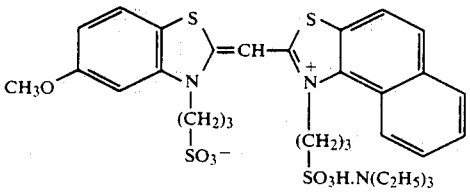
Cpd-1
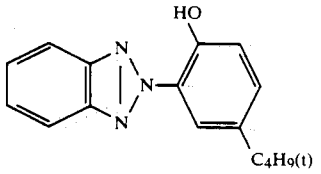
Cpd-2
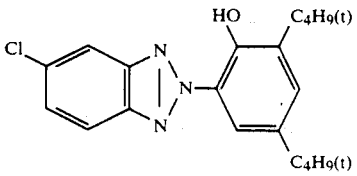

-continued
Cpd-3
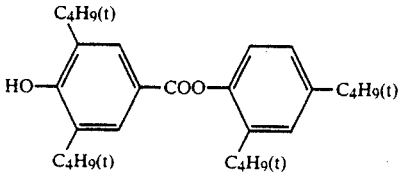
Cpd-4
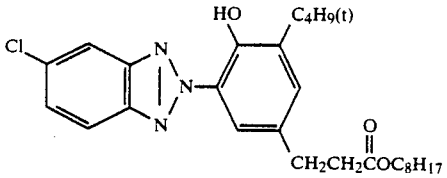
Cpd-5
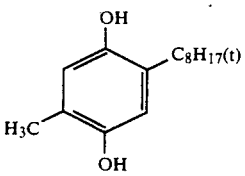
Cpd-6
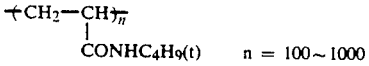
Cpd-7
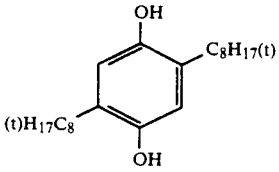
Cpd-8
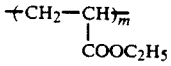
Cpd-9
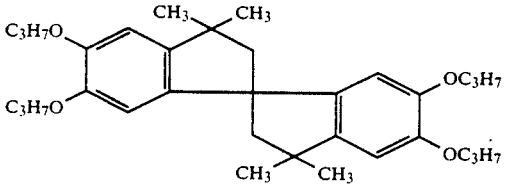
Cpd-10
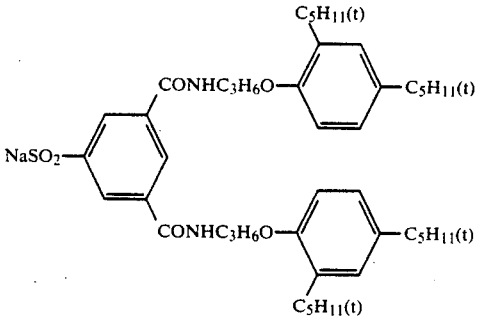
Cpd-11
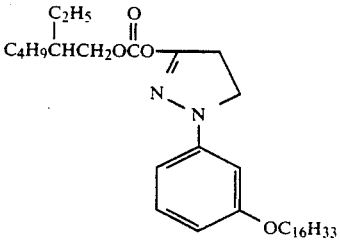

-continued
Cpd-12
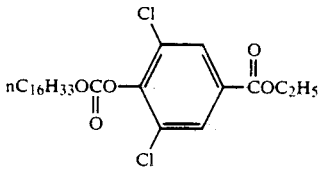
Cpd-13
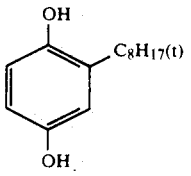
Cpd-14
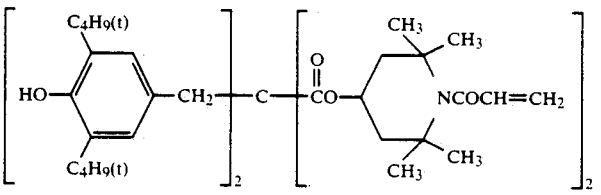
Cpd-15
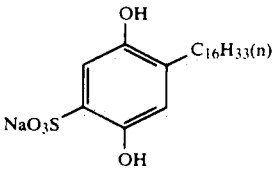
Cpd-16
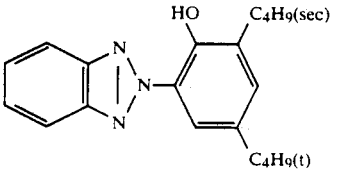
Cpd-17
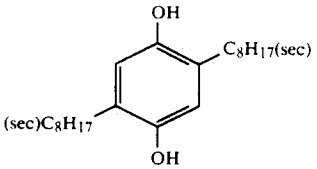
Cpd-18
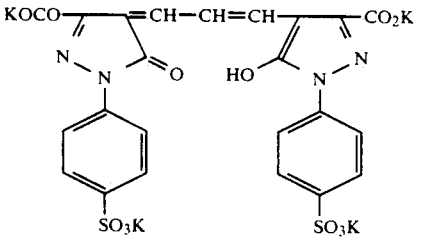
Cpd-19
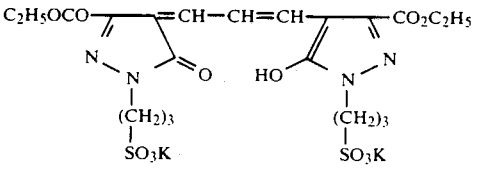

-continued
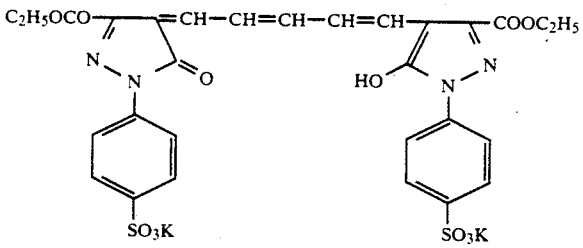
Cpd-20
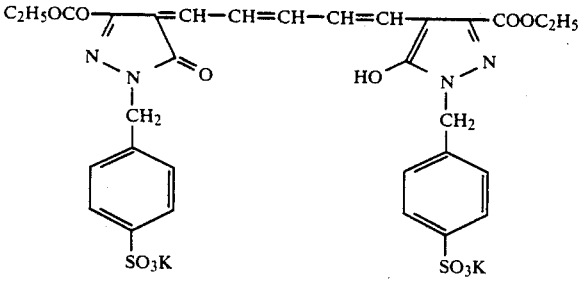
Cpd-21
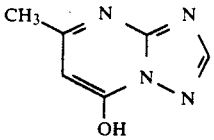
Cpd-23
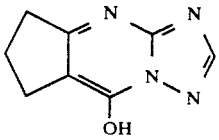
Cpd-24
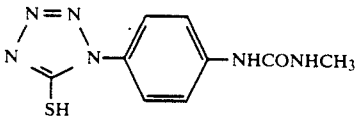
Cpd-25
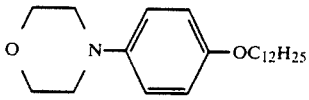
Cpd-26
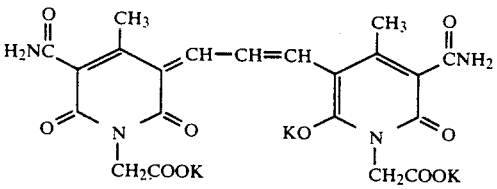
Cpd-22
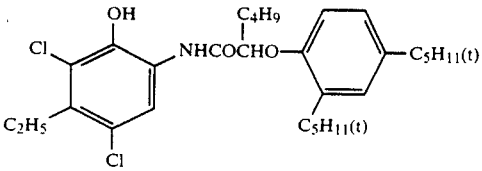
ExC-1

-continued
ExC-2
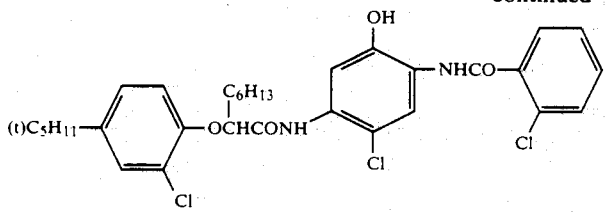
ExC-3
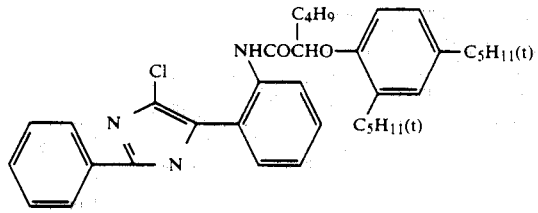
ExM-1
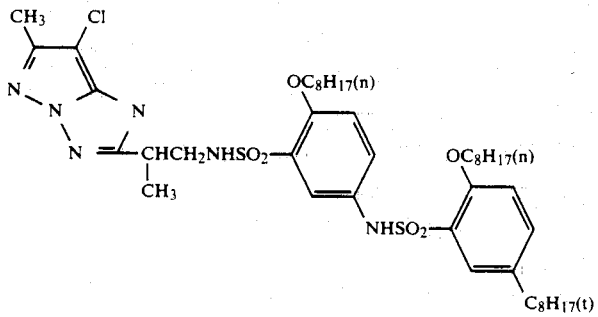
ExM-2
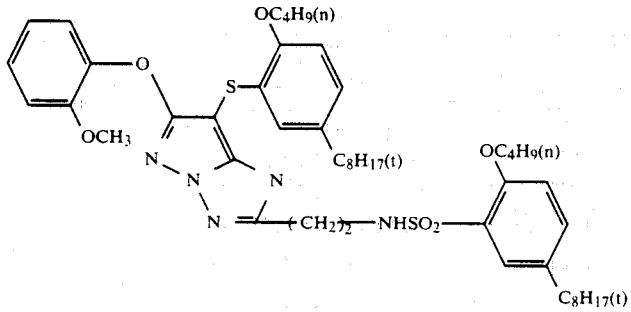
ExM-3
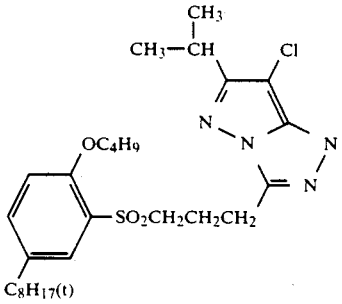
ExY-1
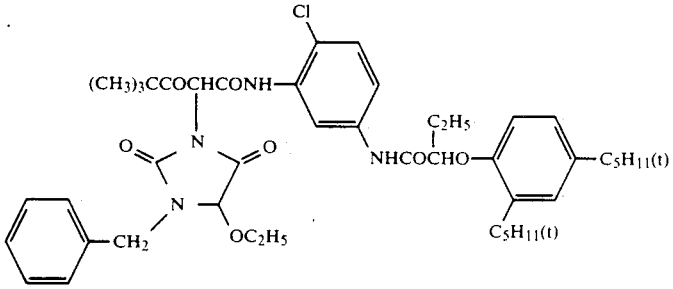

-continued

ExY-2

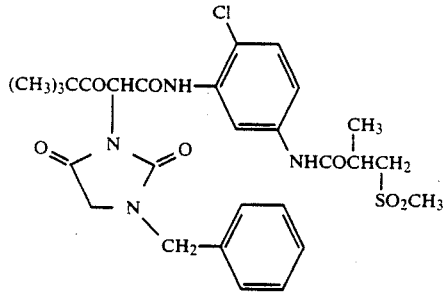

Solv-1: Di(2-ethylhexyl) sebacate Solv-2: Trinonyl phosphate Solv-3: Di(3-methylhexyl) phthalate Solv-4: Tricresyl phosphate Solv-5: Dibutyl phthalate Solv-6: Trioctyl phosphate Solv-7: Di(2-ethylhexyl) phthalate H-1: 1,2-Bis(vinylsulfonylacetamido)ethane H-2: 4,6-Dichloro-2-hydroxy-1,3,5-triazine sodium salt The color photographic light-sensitive materials thus prepared were exposed to light through a wedge (3200° K., 1/10', 100 CMS) and then subjected to Processing Step A described below.

Density of magenta color image formed was measured. The results are shown in Table 1 below.

TABLE 1

| Sample No. | Nucleating Agent | Amount Added (mol/mol Ag) | $D_{max}$ | $D_{min}$ |
|---|---|---|---|---|
| 1 | I-1 | $9.5 \times 10^{-4}$ | 1.52 | 0.12 |
| 2 | I-3 | " | 1.63 | 0.12 |
| 3 | I-7 | " | 1.62 | 0.12 |
| 4 | I-10 | $1.2 \times 10^{-4}$ | 2.10 | 0.12 |
| 5 | I-11 | " | 2.05 | 0.12 |
| 6 | I-14 | " | 2.08 | 0.12 |
| 7 | I-19 | $1.2 \times 10^{-4}$ | 2.10 | 0.12 |
| 8 | Comparative Compound A | $9.5 \times 10^{-4}$ | 1.10 | 0.12 |

Comparative Compound A

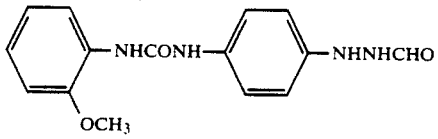

From the results shown in Table 1, it is apparent that Sample Nos. 1 yo 7 containing the nucleating agents according to the present invention are preferred since they exhibit high $D_{max}$ in comparison with Sample No. 8 for comparison.

Further, the similar results were obtained with respect to cyan and yellow color image densities.

Processing Step A:

| Processing Step | Time | Temperature (°C.) |
|---|---|---|
| Color Development | 135 sec. | 38 |
| Bleach-Fixing | 40 sec. | 33 |
| Washing with Water (1) | 40 sec. | 33 |
| Washing with Water (2) | 40 sec. | 33 |
| Drying | 30 sec. | 80 |

The composition of the processing solutions used was as follows.

| | Tank Solution |
|---|---|
| Color Developing solution | |
| D-Sorbitol | 0.15 g |
| Sodium naphthalenesulfonate formaldehyde condensate | 0.15 g |
| Ethylenediaminetetrakismethylene-phosphonic acid | 1.5 g |
| Diethylene glycol | 12.0 ml |
| Benzyl alcohol | 13.5 ml |
| Potassium bromide | 0.80 g |
| Benzotriazole | 0.003 g |
| Sodium sulfite | 2.4 g |
| N,N-Bis(carboxymethyl)hydrazine | 6.0 g |
| D-Glucose | 2.0 g |
| Triethanolamine | 6.0 g |
| N-Ethyl-N-(β-methanesulfonamidoethyl)-3-methyl-4-aminoaniline sulfate | 6.4 g |
| Potassium carbonate | 30.0 g |
| Brightening agent (diaminostilbene type) | 1.0 g |
| Water to make | 1,000 ml |
| pH (at 25° C.) | 10.50 |
| Bleach-Fixing solution | |
| Disodium ethylenediaminetetraacetate dihydrate | 4.0 g |
| Ammonium ethylenediamine-tetraacetato ferrate dihydrate | 70.0 g |
| Ammonium thiosulfate (700 g/liter) | 180 ml |
| Sodium p-toluenesulfinate | 20.0 g |
| Sodium bisulfite | 20.0 g |
| 5-Mercapto-1,3,4-triazole | 0.5 g |
| Ammonium nitrate | 10.0 g |
| Water to make | 1,000 ml |
| pH (at 25° C.) | 6.20 |
| Washing Water (both tank solution and replenisher) | |

City water was passed through a mixed bed type column filled with an H type strong acidic cation exchange resin (Amberlite IR-120B manufactured by Rohm & Haas Col) and an OH type anion exchange resin (Amberlite IR-400 manufactured by Rohm & Haas Co.) to prepare water containing not more than 3 mg/liter of calcium ion and magnesium ion. To the water thus-treated were added sodium dichloroisocyanurate in an amount of 20 mg/liter and sodium sulfate in an amount of 1.5 g/liter. The pH of the solution was in a range from 6.5 to 7.5.

EXAMPLE 2

Color photographic light-sensitive materials were prepared in the same manner as described in Example 1 except that a nucleating agent and a nucleation accelerating agent were added to each emulsion layer as shown in Table 2 below. Then, exposure to light and processing were conducted in the same manner as described in Example 1 except for changing the time for color development to 100 seconds.

Density of cyan color image formed was measured. The results are shown in Table 2 below.

TABLE 2

| Sample No. | Nucleating Agent | Amount Added (mol/mol Ag) | Nucleation Accelerating Agent*1 | $D_{max}$ | $D_{min}$ |
|---|---|---|---|---|---|
| 1 | I-4 | $9.5 \times 10^{-4}$ | A-6 | 2.15 | 0.10 |
| 2 | " | " | A-15 | 2.15 | 0.10 |
| 3 | " | " | — | 1.95 | 0.12 |
| 4 | I-10 | $1.2 \times 10^{-4}$ | A-6 | 2.25 | 0.10 |
| 5 | " | " | A-15 | 2.23 | 0.10 |
| 6 | " | " | — | 1.94 | 0.12 |
| 7 | Comparative Compound A | $9.5 \times 10^{-4}$ | A-6 | 1.15 | 0.11 |
| 8 | Comparative Compound A | " | A-15 | 1.10 | 0.11 |
| 9 | Comparative Compound A | " | — | 0.86 | 0.12 |

*1Amount added: $4.5 \times 10^{4}$ mol/mol Ag

From the results shown in Table 2, it is apparent that Sample Nos. 1 to 6 containing the nucleating agents according to the present invention are preferred since they exhibit high $D_{max}$ in comparison with Sample Nos. 7 to 9 for comparison.

EXAMPLE 3

Preparation of Emulsion X

An aqueous solution of silver nitrate (0.9N, 111 ml, containing silver nitrate in an amount corresponding to to about ⅛ of the total molar quantity of silver nitrate to be used) and an aqueous solution of potassium bromide (0.9N, 120 ml) were simultaneously added at constant addition rate to an aqueous gelatin solution (3%, 500 ml, pH: 5.5) of 75° C. containing 20 mg per liter of thioether (1,8-dihydroxy-3,6-dithiaoctane) under thoroughly stirring for 5 minutes while maintaining a silver electrode potential constantly to obtain a spherical monodisperse silver bromide emulsion having an average grain diameter of about 0.14 μm. 20 mg of sodium thiosulfate and 20 mg of chloroauric acid (4 hydrate) were added to the emulsion per mol of silver halide and the pH was adjusted at 7.5, followed by heating at 75° C for 80 minutes with thoroughly stirring to effect chemical sensitization. The thus-obtained silver bromide grains were used as cores, an aqueous solution of silver nitrate (1.2N, 583 ml, containing silver nitrate in an amount corresponding to about ⅞ of the total molar quantity of silver nitrate to be used) and an aqueous solution of potassium bromide (1.3N, 583 ml) were added simultaneously under thoroughly stirring at the same temperature as above over a period of 40 minutes while maintaining a silver electrode potential for growing regular octahedral grains in order to allow for the growth of shell thereby a cubic monodisperse core/shell type silver bromide emulsion having an average grain diameter of about 0.3 μm was obtained. The pH of the emulsion was adjusted at 6.5 and 5 mg of sodium thiosulfate and 5 mg of chloroauric acid (4 hydrate) were added thereto per mol of silver halide, followed by ripening at 75° C. for 60 minutes to effect chemical sensitization of the surface of shell to finally obtain an internal latent image type octahedral monodisperse core/shell silver bromide emulsion (Emulsion X). As a result of measurement on grain size distribution of the emulsion using electron microscopic photographs, it was found that an average grain diameter was 0.30 μm and a coefficient of variation (percent of a value obtained by dividing a statistical standard deviation with the above-described average grain diameter) was 10%.

To Emulsion X described above was added, as a panchromatic sensitizing dye, 5 mg of 3,3'-diethyl-9-methylthiacarbocyanine per mol of silver halide, and then were added the nucleating agent as shown in Table 3 below and $5.6 \times 10^{-4}$ mol of Nucleation accelerating agent A-6 per mol of silver halide, respectively. The coating solution thus-prepared was coated on a polyethylene terephthalate film support so as to be a silver coating amount of 2.8 g/m² simultaneously with a protective layer composed of gelatin and a hardening agent. Thus, direct positive photographic light-sensitive material Samples No. 1 to No. 5 each being sensitive up to red light were prepared.

These samples were exposed through a step wedge using a sensitometer equipped with a tungsten lamp of 1 KW (color temperature: 2,854° K.) for 0.1 second. Thereafter, each sample was developed at 38° C. for 18 seconds by an automatic developing machine (Kodak Proster I Processor) using Kodak Proster Plus processing solution (developing solution: pH of 10.7), followed by washing with water, fixing and washing with water step by the same processor and dried. The maximum density ($D_{max}$) and the minimum density ($D_{min}$) of direct positive image thus-formed in each sample were measured. The results thus-obtained are shown in Table 3 below.

TABLE 3

| Sample No. | Nucleating Agent | Amount Added (mol/mol Ag) | $D_{max}$ | $D_{min}$ |
|---|---|---|---|---|
| 1 | I-3 | $9.5 \times 10^{-4}$ | 2.39 | 0.06 |
| 2 | I-11 | $1.2 \times 10^{-4}$ | 2.42 | 0.06 |
| 3 | I-14 | " | 2.41 | 0.06 |
| 4 | Comparative Compound A | $9.5 \times 10^{-4}$ | 2.05 | 0.09 |

As is apparent from the results shown in Table 3, Sample Nos. 1 to 3 containing the nucleating agent according to the present invention are preferred since they provide high $D_{max}$ and low $D_{min}$ as compared with Sample No. 4 for comparison.

EXAMPLE 4

Preparation of Core/shell Type Direct Positive Emulsion (EM-1)

An aqueous solution of potassium bromide (0.52N, 500 ml) and an aqueous solution of silver nitrate (0.50N, 500 ml) were simultaneously added at 75° C. over a period of about 60 minutes with vigorous stirring to an aqueous gelatin solution (3%, 600 ml) to obtain a silver bromide emulsion. Before the precipitation, 80 mg of 3,4-dimethyl-1,3-thiazoline-2-thione per mole of silver and 6 g of benzimidazole per mol of silver were added to the precipitation vessel. After the completion of the precipitation, silver bromide crystals having an average grain diameter of about 1.1 μm were formed. Then 5.4 mg of sodium thiosulfate per mol of silver and 3.9 mg of potassium chloroaurate per mol of silver were added to the silver bromide emulsion and the emulsion was heated at 75° C. for 35 minutes to be chemically sensitized. The thus chemically sensitized silver bromide grains were used as cores and to the emulsion were added simultaneously an aqueous solution of potassium bromide (1.2N, 750 ml) and an aqueous solution of silver nitrate (1.0N, 750 ml) over a period of 40 minutes in the same manner as the first step described above to prepare a core/shell emulsion. The final average grain diameter of the emulsion was 1.5 μm.

To the core/shell type emulsion were added 0.50 mg of sodium thiosulfate per mol of silver and 57 mg of poly(N-vinylpyrrolidone) per mol of silver and the emulsion was heated at 60° C. for 45 minutes to be chemically sensitized on the surface of grains, whereby Emulsion (EM-1) was prepared.

Preparation of Liqht-Sensitive Sheet A

On a polyethylene terephthalate transparent film support, Layer 1 to Layer 6 were coated according to the layer structure shown below to prepare Light-Sensitive Sheet A.

Layer 6: Protective layer containing gelatin
Layer 5: Red-sensitive core/shell type direct positive emulsion layer
Layer 4: Layer containing a cyan DRR compound
Layer 3: Light shielding layer
Layer 2: White reflective layer
Layer 1: Mordanting layer

Support

Layer 1: Mordanting layer containing a copolymer having the repeating unit described below in the ratio described below:

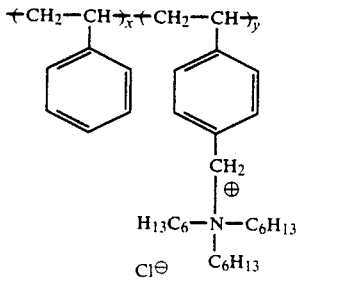

x:y = 50:50 which is described in U.S. Pat. No. 3,898,088 (3.0 g/m² and gelatin (3.0 mg/m²)

Layer 2: White reflective layer containing titanium oxide (20 g/m²) and gelatin (2.0 g/m²)
Layer 3: Light-shielding layer containing carbon black (2.0 g/m²) and gelatin (1.5 g/m²)
Layer 4: Layer containing a cyan DRR compound described below (0.44 ) g/m²), tricyclohexyl phosphate (0.09 g/m²) and gelatin (0.8 g/m²)

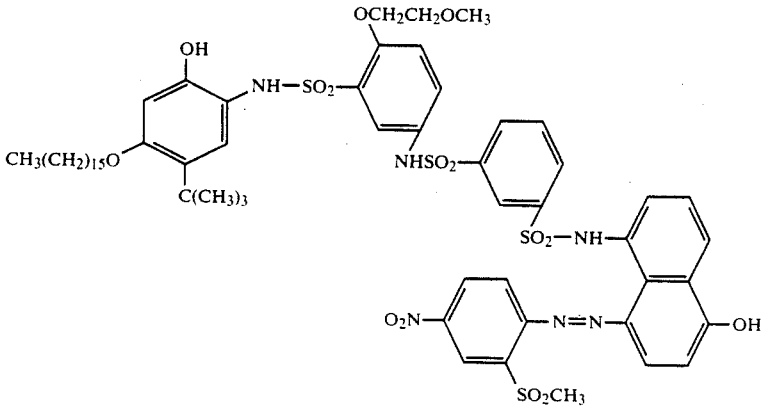

Layer 5: Red-sensitive core/shell type direct positive silver bromide emulsion layer containing Emulsion (EM-1) described above (0.81 g/m² as silver), a red-sensitizing dye (the aforementioned ExS-1, 2, 3), the nucleating agent and the nucleation accelerating agent as shown in Table 4 below, 4-hydroxy-6-methyl-1,3,3a,7-tetraazaindene (4.3 mg/m2) and sodium 5-penta decylhydroquinone-2-sulfonate (0.11 g/m²)

Layer 6: Protective layer containing gelatin (1.0 g/m²)

| Processing Solution: | |
|---|---|
| 1-p-Tolyl-4-methyl-4-hydroxymethyl-3-pyrazolidone | 12.0 g |
| Methylhydroquinone | 0.3 g |
| 5-Methylbenzotriazole | 3.5 g |
| Sodium sulfite | 2.0 g |
| Sodium salt of carboxymethyl cellulose | 58 g |
| Potassium hydroxide | 56 g |
| Benzyl alcohol | 1.5 g |
| Carbon black dispersion (25%) | 600 g |
| Water to make | 1 kg |

0.8 g portions of the processing solution having the above-described composition were retained in "pressure-rupturable containers".

Cover Sheet:

On a polyethylene terephthalate transparent film support, Layer 1′ to Layer 3′ described below were coated in this order to prepare a cover sheet.

Layer 1′: Neutralizing layer containing a copolymer of acrylic acid and butyl acrylate (weight ratio: 80/20) (22 g/m²) and 1,4-bis(2,3-epoxypropoxy)butane (0.44 g/m²)
Layer 2′: Layer containing acetyl cellulose (as modified by hydrolysis of 100 g acetyl cellulose to form 39.4 g of acetyl group) (3.8 g/m²), a copolymer of styrene and maleic anhydride (weight ratio 60/40, molecular weight: about 50,000) (0.2 g/m²) and 5-(β-cyanoethylthio)-1-phenyltetrazole (0.115 g/m²)
Layer 3′: Layer containing a copolymer latex of vinyl-idene chloride, methyl acrylate and acrylic acid (weight ratio: 85/12/3) (2.5 g/m²) and polymethyl methacrylate latex (particle size: 1 to 3 μm) (0.05 g/m²)

Exposure to Light and Development Processing

The above-described cover sheet was superposed on each of the above-described light-sensitive sheets, and image exposure was conducted through a continuous gradation wedge from the cover sheet side. Then, the above-described processing solution was spread in a thickness of 75 μm between these two sheets using pressure-applying rollers. THe spread processing was conducted at 25° C. 100 Seconds after the processing, cyan color density of the image transferred on the mordanting layer (image-receiving layer) was measured through the transparent support of the light-sensitive sheet by a reflective densitometer. The results thus-obtained are shown in Table 4 below.

TABLE 4

| Sample No. | Nucleating Agent | Amount Added (mol/mol Ag) | Nucleation Accelerating Agent*1 | $D_{max}$ | $D_{min}$ |
|---|---|---|---|---|---|
| 1 | I-2 | $3.5 \times 10^{-4}$ | A-9 | 2.35 | 0.28 |
| 2 | " | " | A-27 | 2.36 | 0.28 |
| 3 | " | " | — | 2.05 | 0.30 |
| 4 | I-11 | $2.6 \times 10^{-5}$ | A-9 | 2.32 | 0.28 |
| 5 | " | " | A-27 | 2.35 | 0.27 |
| 6 | " | " | — | 2.02 | 0.30 |
| 7 | Comparative Compound A | $3.5 \times 10^{-4}$ | A-9 | 1.81 | 0.29 |
| 8 | Comparative Compound A | " | A-27 | 1.78 | 0.29 |
| 9 | Comparative Compound A | " | — | 1.45 | 0.30 |

*1Amount added: $4.5 \times 10^{-4}$ mol/mol Ag

As is apparent from the results shown in Table 4, Sample Nos. 1 to 6 containing the nucleating agent according to the present invention are preferred since they provide high $D_{max}$ as compared with Sample Nos. 7 to 9 for comparison.

While the invention has been described in detail and with reference to specific embodiments thereof, it will be apparent to one skilled in the art that various changes and modifications can be made therein without departing from the spirit and scope thereof.

What is claimed is:

1. A method for forming a direct positive image in an image-wise exposed direct positive photographic light-sensitive material which comprises a support having thereon at least one layer containing internal latent image type silver halide grains not having been previously fogged comprising:

conducting a fogging treatment of the grains in the presence of a compound represented by the following general formula (I), and after the fogging treatment or during the fogging treatment subjecting the material to development processing:

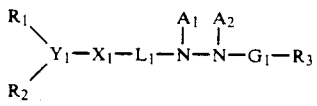

(I)

wherein $A_1$ and $A_2$ both represent a hydrogen atom or one of $A_1$ and $A_2$ represents a hydrogen atom and the other represents a sulfonyl group or an acyl group; $G_1$ represents a carbonyl group, a sulfonyl group, a sulfoxy group,

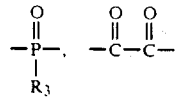

or an iminomethylene group; $L_1$ represents a divalent linkage group; $X_1$ represents —O— or

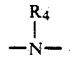

(wherein $R_4$ represents a hydrogen atom, an alkyl group or an aryl group); $Y_1$ represents

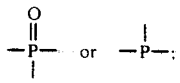

$R_1$ and $R_2$ each represents an aliphatic group, an aromatic group, a hetero-cyclic group, $—OR_5$ or $—NR_5R_6$ (wherein $R_5$ represents an aliphatic group, an aromatic group or a heterocyclic group; and $R_6$ represents a hydrogen atom, an aliphatic group, an aromatic group or a heterocyclic group); and $R_3$ represents a hydrogen atom, an alkyl group, an aryl group, an alkoxy group, an aralkyl group, an aryloxy group or an amino group.

2. A direct positive image forming method as claimed in claim 1, wherein the sulfonyl group or acyl group represented by $A_1$ or $A_2$ has up to 20 carbon atoms.

3. A direct positive image forming method as claimed in claim 1, wherein both $A_1$ and $A_2$ are a hydrogen atom.

4. A direct positive image forming method as claimed in claim 1, wherein the aliphatic group represented by $R_1$, $R_2$, $R_5$ or $R_6$ is a straight chain, branched chain or cyclic alkyl group, alkenyl group or alkynyl group each containing up to 30 carbon atoms, and the branched chain alkyl group may contain one or more hetero atoms therein to form a saturated hetero ring.

5. A direct positive image forming method as claimed in claim 1, wherein the aromatic group represented by $R_1$, $R_2$, $R_5$ or $R_6$ is a monocyclic or dicyclic aryl group.

6. A direct positive image forming method as claimed in claim 1, wherein the heterocyclic group represented by $R_1$, $R_2$, $R_5$ or $R_6$ is a 3membered to 10-membered saturated or unsaturated heterocyclic group containing at least one of a nitrogen atom, an oxygen atom or a sulfur atom which may be a monocyclic ring or form a condensed ring together with an aromatic ring or a heterocyclic ring.

7. A direct positive image forming method as claimed in claim 1, wherein a substituent for the aliphatic group, aromatic group or heterocyclic group represented by $R_1$, $R_2$, $R_5$ or $R_6$ is selected from an alkyl group, an aralkyl group, an alkoxy group, an aryl group, a substituted amino group, an acylamino group, a sulfonylamino group, ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group and a carboxy group.

8. A direct positive image forming method as claimed in claim 1, wherein $R_1$ or $R_2$ may combine with $L_1$ to form a ring, or $R_1$ and $R_2$ may combine with each other to form a ring.

9. A direct positive image forming method as claimed in claim 1, wherein the divalent linkage group represented by $L_1$ is an atom or an atomic group including at least one of a carbon atom, a nitrogen atom, a sulfur atom and an oxygen atom.

10. A direct positive image forming method as claimed in claim 9, wherein the divalent linkage group represented by $L_1$ is an arylene group.

11. A direct positive image forming method as claimed in claim 9, wherein a substituent for the divalent linkage group represented by $L_1$ is selected from an alkyl group, an aralkyl group, an alkoxy group, an aryl group, an aryloxy group, an alkenyl group, an alkylthio group, an arylthio group, a sulfonyl group, a sulfinyl group, a halogen atom, a cyano group, an acyl group, a nitro group and

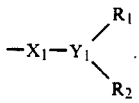

12. A direct positive image forming method as claimed in claim 1, wherein $G_1$ represents a carbonyl group, and $R_3$ represents a hydrogen atom, an alkyl group, an aralkyl group or an aryl group.

13. A direct positive image forming method as claimed in claim 1, wherein $G_1$ represents a sulfonyl group, and $R_3$ represents an alkyl group, an aralkyl group, an aryl group or a substituted amino group.

14. A direct positive image forming method as claimed in claim 1, wherein $G_1$ represents a sulfoxy group, and $R_3$ represents a cyanobenzyl group or a methylthiobenzyl group.

15. A direct positive image forming method as claimed in claim 1, wherein $G_1$ represents

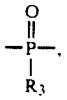

and $R_3$ represents a methoxy group, an ethoxy group, a butoxy group, a phenoxy group or a phenyl group.

16. A direct positive image forming method as claimed in claim 1, wherein $G_1$ represents an N-substituted or unsubstituted iminomethylene group, and $R_3$ represents a methyl group, an ethyl group or a substituted or unsubstituted phenyl group.

17. A direct positive image forming method as claimed in claim 1, wherein a substituent for the group represented by $R_3$ is selected from an alkyl group, an aralkyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxy group, an acyloxy group, an acyl group, an alkyloxycarbonyl group, an aryloxycarbonyl group, an alkenyl group, an alkynyl group and a nitro group.

18. A direct positive image forming method as claimed in claim 1, wherein $G_1$ represents a carbonyl group, and $R_3$ represents a hydrogen atom or a group represented by the following general formula (a):

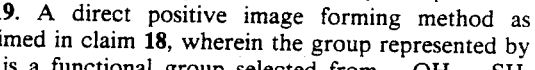

$$-L_2-Z_1 \qquad (a)$$

wherein $Z_1$ represents a group capable of cleaving the $G_1-L_2-Z_1$ moiety from the remainder molecule upon a nucleophilic attack on $G_1$; and $L_2$ is a divalent organic group capable of forming a $G_1$, $L_2$ and $Z_1$ cyclic structure upon the nucleophilic attack of $Z_1$ on $G_1$.

19. A direct positive image forming method as claimed in claim 18, wherein the group represented by $Z_1$ is a functional group selected from —OH, —SH, —$NHR_7$ (wherein $R_7$ represents a hydrogen atom, an alkyl group, an aryl group, a heterocyclic group, —$COR_8$ or —$SO_2R_8$; and $R_8$ represents a hydrogen atom, an alkyl group, an aryl group or a heterocyclic group) or —COOH, or a functional group selected from

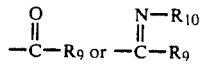

(wherein $R_9$ and $R_{10}$ each represents a hydrogen atom, an alkyl group, an alkenyl-group, an aryl group or a heterocyclic group).

20. A direct positive image forming method as claimed in claim 18, wherein the divalent organic group represented by $L_2$ is an atom or an atomic group including at least one of a carbon atom, a nitrogen atom, a sulfur atom and an oxygen atom.

21. A direct positive image forming method as claimed in claim 18, wherein the group represented by the general formula (a) is a group represented by the following general formula (b):

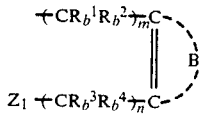

(b)

wherein $R_b^1$, $R_b^2$, $R_b^3$ and $R_b^4$, which may be the same or different, each represents a hydrogen atom, an alkyl group, an alkenyl group or an aryl group; B represents an atomic group necessary to form a 5-membered or 6-membered ring which may be substituted; m and n each represents 0 or 1, when $Z_1$ is —COOH, n+m is 0 or 1, and when $Z_1$ is —OH, —SH or —$NHR_4$, n+M is 1 or 2; and $Z_1$ has the same meaning as defined in the general formula (a).

22. A direct positive image forming method as claimed in claim 21, wherein m is 0 and n is 1.

23. A direct positive image forming method as claimed in claim 21, wherein the ring formed with B is a benzene ring.

24. A direct positive image forming method as claimed in claim 18, wherein the group represented by the general formula (a) is a group represented by the following general formula (c):

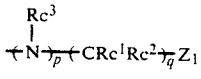

(c)

wherein $Rc^1$ and $Rc^2$, which may be the same or different, each represents a hydrogen atom, an alkyl group, an alkenyl group, an aryl group or a halogen atom; $Rc^3$ represents a hydrogen atom, an alkyl group, an alkenyl group or an aryl group; p represents 0 or 1; q represents 1, 2, 3 or 4; and $Z_1$ has the same meaning as defined in the general formula (a), or $Rc^1$, $Rc^2$ and $Rc^3$ may combine with each other to form a ring as for as the resulting structure makes possible an intramolecular nucleophilic attach of $Z_1$ on $G_1$; and when q represents 2 or 3, two or three $CRc^1Rc^2$'s may be the same or different.

25. A direct positive image forming method as claimed in claim 24, wherein $Rc^1$ and $Rc^2$ each represents a hydrogen atom, a halogen atom or an alkyl group, $Rc^3$ represents an alkyl group or an aryl group, and when q is 1, p is 0 or 1, when q is 2, p is 0 or 1, and when q is 3, p is 0 or 1.

26. A direct positive image forming method as claimed in claim 1, wherein $X_1$ represents —$NR_4$— wherein $R_4$ represents a hydrogen atom.

27. A direct positive image forming method as claimed in claim 1, wherein $Y_1$ represents

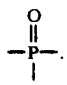

28. A direct positive image forming method as claimed in claim 1, wherein $R_1$ or $R_2$ contains a ballast group.

29. A direct positive image forming method as claimed in claim 1, wherein $R_1$, $R_2$, $L_1$ or $R_3$ contains an adsorption accelerating group on the surface of silver halide represented by the following formula:

$$Y_2-(L_3)_l-$$

wherein $Y_2$ represents a adsorption accelerating group for silver halide; $L_3$ represents a divalent linkage group; and l represents 0 or 1.

30. A direct positive image forming method as claimed in claim 29, wherein the adsorption accelerating group represented by $Y_2$ is a thioamido group, a mercapto group, a group haying a disulfido bond, or a 5-membered or 6-membered nitrogen-containing heterocyclic group.

31. A direct positive image forming method as claimed in claim 30, wherein the thioamido adsorption accelerating group represented by $Y_2$ is a divalent group represented by

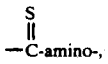

which may be a part of ring structure or an acylic thioamido group.

32. A direct positive image forming method as claimed in claim 29, wherein $Y_2$ is a cyclic thioamido group or a nitrogen-containing heterocyclic group.

33. A direct positive image forming method as claimed in claim 29, wherein the divalent linkage group represented by $L_3$ is an atom or an atomic group including at least one of a carbon atom, a nitrogen atom, a sulfur atom and an oxygen atom.

34. A direct positive image forming method as claimed in claim 1, wherein the compound is represented by the following general formula (Ia):

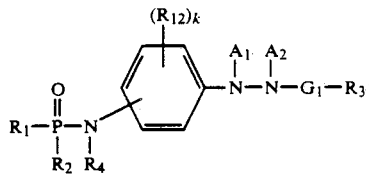

(Ia)

wherein $R_{12}$ has the same meaning as $R_1$ or $R_2$ in the general formula (1); k represents 0, 1 or 2; and $R_1$, $R_2$, $R_3$, $R_4$, $A_1$, $A_2$ and $G_1$ each has the same meaning as defined in the general formula (1).

35. A direct positive image, forming method as claimed in claim 34, wherein the

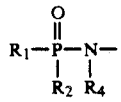

group is present at the o- or p- position to the hydrazino group.

36. A direct positive image forming method as claimed in claim 1, wherein the compound represented by the general formula (I) is present in the direct positive photographic light-sensitive material.

37. A direct positive image forming method as claimed in claim 1, wherein the pH of the color developing solution used in the development process is in a range from 9.0 to 12.0.

38. A direct positive image forming method as claimed in claim 37, wherein the pH is in a range from 9.5 to 11.5.

39. A direct positive image forming method as claimed in claim 38, wherein the pH is in a range from 9.8 to 11.0.

40. A direct positive photographic light-sensitive material comprising a support having thereon at least one internal latent image type silver halide emulsion layer not having been previously fogged, wherein the photographic light-sensitive material contains at least one compound represented by the following general formula (I)

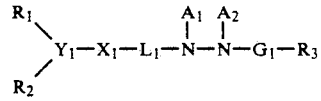

(I)

whrein $A_1$ and $A_2$ both represent a hydrogen atom or one of $A_1$ and $A_2$ represents a hydrogen atom and the other represents a sulfonyl group or an acyl group; $G_1$ represents a carbonyl group, a sulfonyl group, a sulfoxy group,

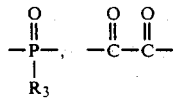

or an iminomethylene group; $L_1$ represents a divalent linkage group; $X_1$ represents —O— or

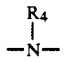

(wherein $R_4$ represents a hydrogen atom, an alkyl group or an aryl group); $Y_1$ represents

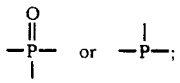

$R_1$ and $R_2$ each represents an aliphatic group, an aromatic group, a heterocyclic group, —$OR_5$ or —$NR_5R_6$ (wherein $R_5$ represents an aliphatic group, an aromatic group or a heterocyclic group; and $R_6$ represents a hydrogen atom, an aliphatic group, an aromatic group or a heterocyclic group); and $R_3$ represents a hydrogen atom, an alkyl group, an aryl group, an alkoxy group, an aralkyl group, an aryloxy group or an amino group.

41. A direct positive photographic light-sensitive material as claimed in claim 40, wherein the compound represented by the general formula (I) is present in an internal latent image type silver halide emulsion layer, an intermediate layer, a subbing layer or a backing layer.

42. A direct positive photographic light-sensitive material as claimed in claim 41, wherein the compound is present in an internal latent image type silver halide emulsion layer.

43. A direct positive photographic light-sensitive material as claimed in claim 41, wherein the internal latent image type silver halide emulsion layer is a monodisperse silver halide emulsion layer.

44. A direct positive photographic light-sensitive material as claimed in claim 41, wherein the photographic light-sensitive material further contains a color coupler.

45. A direct positive photographic light-sensitive material as claimed in claim 44, wherein the color coupler is selected from a naphtholic or phenolic cyan coupler, a pyrazolone or pyrazoloazole magenta coupler and an open chain or heterocyclic ketomethylene yellow coupler.

46. A direct positive photographic light-sensitive material as claimed in claim 41, wherein the photographic light-sensitive material comprises at least one red-sensitive silver halide emulsion layer containing at least one cyan forming coupler, at least one green-sensitive silver halide emulsion layer containing at least one magenta forming coupler and at least one blue-sensitive silver halide emulsion layer containing at least one yellow forming coupler.

47. A direct positive photographic light-sensitive material as claimed in claim 41, wherein the photographic light-sensitive material further contains a nucleation accelerating agent.

48. A direct positive photographic light-sensitive material as claimed in claim 47, wherein the nucleation accelerating agent is a compound represented by the following general formula (II) or (III):

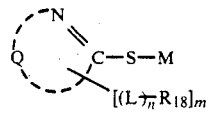

(II)

wherein Q represents an atomic group necessary to form a 5-membered or 6-membered heterocyclic ring to which a carbocyclic aromatic ring or a heterocyclic aromatic ring may further be condensed; L represents a divalent linkage group comprising an atom or atomic group selected from the group consisting of a hydrogen atom, a carbon atom, a nitrogen atom, an oxygen atom, and a sulfur atom; $R_{18}$ represents an organic group containing at least one of a thioether group, an aminO group, an ammonium group, an ether group, or a heterocyclic group; n represents 0 or 1; m represents 0, 1 or 2; and M represents a hydrogen atom, an alkali metal atom, an ammonium group or a group capable of being cleaved under an alkaline condition,

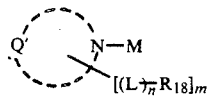

(III)

wherein Q′ represents an atOmiC group necessary tO fOrm a 5-membered or 6-membered heterocyclic ring which is capable of forming imino silver; L, $R_{18}$, n and M each has the same meaning as defined in the general fOrmula (II) above; and m represents 1 or 2.

49. A direct positive photographic light-sensitive material as claimed in claim 48, wherein the heterocyclic ring completed with Q is substituted with a substituent selected from a nitro group, a halogen atom, a mercapto group, a cyano group, a substituted or unsubstituted alkyl group, a substituted or unsubstituted aryl group, a substituted or unsubstituted alkenyl group, a substituted or unsubstituted aralkyl group, a sulfonyl group, a carbamoyl group, a sulfamoyl group, a carbonamido group, a sulfonamido group, an acyloxy group, a sulfonyloxy group, a ureido group, a thioureido group, an acyl group, an oxycarbonyl group, and an oxycarbonylamino group.

50. A direct positive photographic light-sensitive material as claimed in claim 48, wherein the heterocyclic ring completed with Q is a tetrazole, a triazole, an imidazole, a thiadiazole or an oxadiazole.

51. A direct positive photographic light-sensitive material as claimed in claim 48, wherein the heterocyclic ring represented by Q′ is an indazole, a benzimidazole, a benzotriazole, a benzoxazole, a benzothiazole, an imidoazole, a thiazole, an oxazole, a triazole, a tetrazole, a tetraazaindene, a triazaindene, a diazaindene, a pyrazole or an indole.

52. A direct positive photographic light-sensitive material as claimed in claim 48, wherein the nucleation accelerating agent is a compound represented by the following general formula (IV), (V), (VI) or (VII):

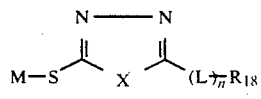

(IV)

wherein M, $R_{18}$, L and n each has the same meaning as defined in the general formula (II); and X represents an oxygen atom, a sulfur atom or a selenium atom,

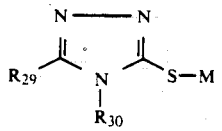

(V)

wherein $R_{29}$ represents a hydrogen atom, a halogen atom, a nitro group, a mercapto group, an unsubstituted amino group, a substituted or unsubstituted alkyl group, a substituted or unsubstituted alkenyl group, a substituted or unsubstituted aralkyl group, a substituted or unsubstituted aryl group or $\text{-}(L)_n R_{18}$; $R_{30}$ represents a hydrogen atom, an unsubstituted amino group or $\text{-}(L)_n R_{18}$, when both $R_{29}$ and $R_{30}$ represent $\text{-}(L)_n R_{18}$, they may be the same or different, provided that at least one of $R_{29}$ and $R_{30}$ represents $\text{-}(L)_n R_{18}$; and M, $R_{18}$, L and n each has the same meaning as defined in the general formula (II),

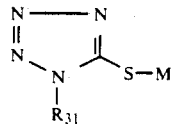

(VI)

wherein $R_{31}$ represents $\text{-}(L)_n R_{18}$; and M, $R_{18}$, L and n each has the same meaning as defined in the general formula (II),

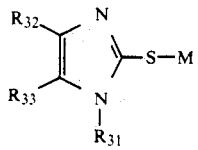

(VII)

wherein $R_{32}$ and $R_{33}$, which may be the same or different, each represents a hydrogen atom, a halogen atom, a substituted or unsubstituted amino group, a nitro group, a substituted or unsubstituted alkyl group, a substituted or unsubstituted alkenyl group, a substituted or unsubstituted aralkyl group or a substituted or unsubstituted aryl group; M and $R_{31}$ each has the same meaning as defined in the general formula (VI).

53. A direct positive photographic light-sensitive material as claimed in claim 47, wherein the nucleation accelerating agent is present in an internal latent image type silver halide emulsion layer or a hydrophilic colloid layer.

* * * * *